US008800854B2

(12) United States Patent
Chapman et al.

(10) Patent No.: US 8,800,854 B2
(45) Date of Patent: Aug. 12, 2014

(54) REINFORCING SUPPORT ASSEMBLIES FOR A CONTAINER AND METHOD OF MAKING SAME

(75) Inventors: Jeffrey H. Chapman, Villa Hills, KY (US); Matthew Swenson, Carol Stream, IL (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 308 days.

(21) Appl. No.: 13/168,153

(22) Filed: Jun. 24, 2011

(65) Prior Publication Data

US 2012/0325830 A1 Dec. 27, 2012

(51) Int. Cl.
*B65D 5/50* (2006.01)

(52) U.S. Cl.
USPC ..... 229/199; 299/109; 299/122.32

(58) Field of Classification Search
USPC ..... 229/109, 199, 122.32, 120.06, 117.15, 229/120.38; 220/651; 493/89, 152
See application file for complete search history.

(56) References Cited

U.S. PATENT DOCUMENTS

| | | | | |
|---|---|---|---|---|
| 2,163,828 | A | 8/1938 | Chalmers | |
| 2,967,655 | A | 1/1961 | Seger | |
| 3,836,065 | A | 9/1974 | Hackenberg | |
| 4,120,443 | A | 10/1978 | Gardner et al. | |
| 4,826,016 | A | 5/1989 | Foster | |
| 5,147,271 | A | 9/1992 | Bacques et al. | |
| 5,316,210 | A * | 5/1994 | Scullin | 229/117.16 |
| 5,372,299 | A | 12/1994 | Edgerton, Jr. et al. | |
| 5,593,087 | A | 1/1997 | Ross et al. | |
| 5,950,911 | A * | 9/1999 | Naughton et al. | 229/109 |
| 5,950,915 | A | 9/1999 | Moen | |
| 6,244,502 | B1 * | 6/2001 | Hollar et al. | 229/120.011 |
| 6,499,655 | B1 | 12/2002 | Moen | |
| 6,520,898 | B1 | 2/2003 | Moen | |
| 7,922,069 | B2 | 4/2011 | Gardner | |
| 2006/0124712 | A1 | 6/2006 | Weimer, Jr. | |
| 2007/0228119 | A1 * | 10/2007 | Barner | 229/109 |
| 2008/0078819 | A1 * | 4/2008 | Strong et al. | 229/109 |
| 2008/0237320 | A1 * | 10/2008 | Philips | 229/109 |
| 2008/0265010 | A1 | 10/2008 | Montague Kisch | |
| 2008/0314794 | A1 * | 12/2008 | Bowman | 206/756 |
| 2009/0277952 | A1 * | 11/2009 | Smith | 229/109 |
| 2011/0011922 | A1 | 1/2011 | Little | |

OTHER PUBLICATIONS

Search Report and Written Opinion dated Aug. 1, 2012, PCT Application No. PCT/US 2012/038557 (17 pages).

* cited by examiner

*Primary Examiner* — Justin Larson
*Assistant Examiner* — Phillip Schmidt
(74) *Attorney, Agent, or Firm* — Armstrong Teasdale LLP

(57) ABSTRACT

A container assembly is provided. The container assembly includes a container formed from a first blank of sheet material. The container includes a bottom wall and a plurality of sides extending upwardly from the bottom wall such for defining a cavity therein. Each side includes an inner surface that extends between a bottom edge positioned between the bottom wall and a top edge. Each inner surface includes a height that is measured between the top edge and the bottom edge. At least one support assembly formed from a second blank of sheet material is positioned within the cavity. The support assembly includes a back panel assembly that is coupled to the inner surface of one of the plurality of sides. An extension assembly extends outwardly from the back panel assembly.

25 Claims, 19 Drawing Sheets

REINFORCING SUPPORT ASSEMBLIES FOR A CONTAINER AND METHOD OF MAKING SAME

BACKGROUND OF THE INVENTION

This subject matter described herein relates generally to reinforcing support assemblies for a container formed from a blank of sheet material, and more specifically to a reinforcing support assembly for reinforcing an end wall of a container and providing a divider within the container.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks of sheet material that are folded along a plurality of preformed fold lines to form an erected corrugated container.

At least some known containers are configured to hold a plurality of goods therein. Most of these known containers are formed from a relatively large blank having a plurality of panels that fold and/or wrap to define the container. More specifically, the plurality of panels form a rectangular cavity into which the goods are inserted. Because these containers are formed from a relatively large blank of sheet material they can be expensive to make.

After being loaded with goods to be shipped, at least some of these known containers are stacked on top of each other, placed on a pallet, and loaded into a truck for shipment. Since these containers are stacked on top of one another, it is important that these containers provide a sufficient amount of stacking strength such that the containers do not collapse during shipment. A container that collapses during shipment may result in damaged goods within the container. Known methods used to increase the stacking strength of a container include increasing the thickness of the sheet material used to form the container. Of course, by increasing the thickness of the material, one increases the expense and complexity in forming the container. Another known method to increase the stacking strength of a container is to increase the number of sides of the container (e.g. going from 4-sides to 8-sides). What is needed is a container that has increased stacking strength with minimal material and a divider for protecting materials within the container.

None of these known containers includes a plurality of support assemblies that are positioned within the container to support the container sidewalls and increase the structural strength and rigidity of the container. It would be beneficial to have a container that includes a support assembly that supports the container sidewalls to enable the container to be formed using less material to form the sidewalls while still increasing the stacking strength.

BRIEF DESCRIPTION OF THE INVENTION

In one aspect, a container assembly is provided. The container assembly includes a container formed from a first blank of sheet material. The container includes a bottom wall and a plurality of sides extending upwardly from the bottom wall such for defining a cavity therein. Each side includes an inner surface that extends between a bottom edge positioned between the bottom wall and a top edge. Each inner surface includes a height that is measured between the top edge and the bottom edge. At least one support assembly formed from a second blank of sheet material is positioned within the cavity. The support assembly includes a back panel assembly that is coupled to the inner surface of one of the plurality of sides. An extension assembly extends outwardly from the back panel assembly. The back panel assembly includes a height that is measured between a lower edge positioned adjacent the bottom wall and an opposite upper edge, wherein the back panel assembly height is approximately equal to the inner surface height.

In another aspect, a container assembly formed from a plurality of blanks of sheet material is provided. The container assembly includes a container formed from a first blank of sheet material. The container includes a bottom wall, a pair of end walls, a pair of sidewalls extending between the pair of end walls, and a plurality of corner walls extending between each of the end walls and the sidewalls such that a cavity is defined between the bottom wall, the end walls, the sidewalls, and the corner walls. At least one support assembly is formed from a second blank of sheet material and is positioned within the cavity. The support assembly includes a pair of back panels and a pair of extension panels. The pair of back panels are coupled to a first end wall of the pair of end walls in a face-to-face relationship. The pair of extension panels extends outwardly from the pair of back panels towards a second end wall. Each back panel of the pair of back panels extends outwardly from the end walls in an opposite direction.

In a further aspect, a blank assembly for forming a container assembly including a container and a support assembly positioned within the container is provided. The blank assembly includes a first blank of sheet material for forming the support assembly. The first blank includes a plurality of panels, wherein each panel is foldably adjoined to an adjacent panel. The plurality of panels includes a first back panel, a first extension panel connected to the first back panel, a second extension panel connected to the first extension panel, and a second back panel connected to the second extension panel. The first extension panel is between the second extension panel and the first back panel and the second extension panel is between the second back panel and the first extension panel.

In yet another aspect, a method of forming a container assembly from a blank assembly is provided. The method includes forming a container from a first blank of sheet material. The container includes a bottom wall and at least one sidewall extending outwardly from the bottom wall such that a cavity is defined therein. A support assembly is formed from a second blank of sheet material. The support assembly includes an extension assembly extending outwardly from a back panel assembly. The support assembly is positioned within the container cavity. The back panel assembly is coupled to an end wall of the container such that the extension assembly is oriented substantially perpendicularly from the end wall and extends into the cavity.

DETAILED DESCRIPTION OF THE INVENTION

The exemplary methods and systems described herein overcome at least some disadvantages of known containers by providing a container assembly that includes a container and a reinforcing support assembly positioned within the container. Moreover, the container assembly described herein includes a reinforcing support assembly that includes a back panel assembly that is coupled to an end wall of the container and an extension assembly that extends outwardly from the back panel assembly. By providing a support assembly that is coupled to an end wall of the container, the overall stacking strength and rigidity of the container is improved. In addition, the extension assembly reduces the movement and shifting of goods stored within the container during transportation. The extension assemblies are configured to only extend partially across the volume of the container such that if the container is converted to a display container, the extension assemblies do not block a customer's view of the products stored proximate the rear of the container. The container assembly shown herein is configured to use an increased number of sides of the container in combination with a support assembly to provide increased structural rigidity and stacking strength while using less material over known containers. Thus, the present container assembly provides increased strength while reducing the cost of fabricating the container assembly.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

Figure 1:
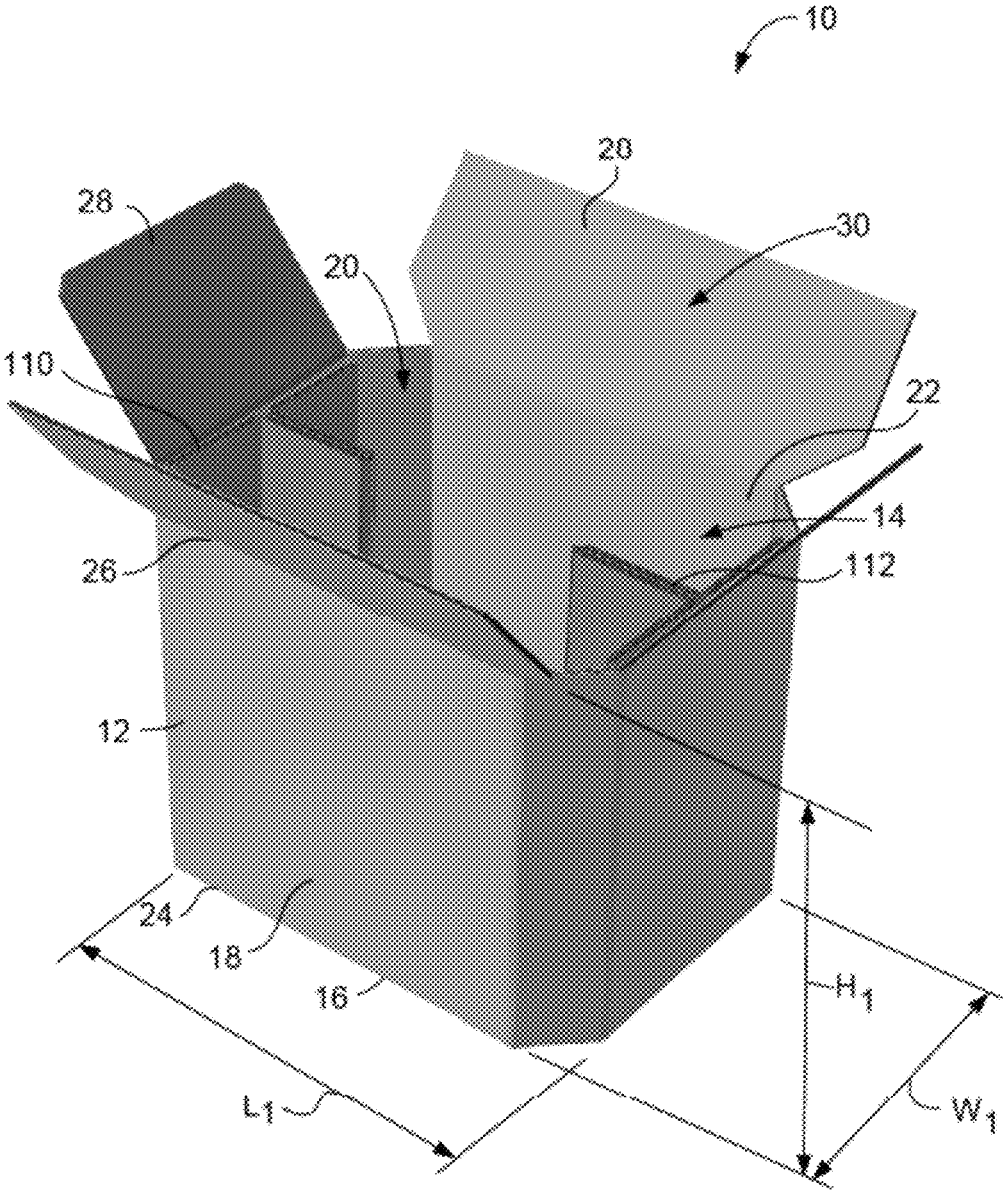
FIG. 1 is a perspective view of an exemplary container assembly.
Figure 2:
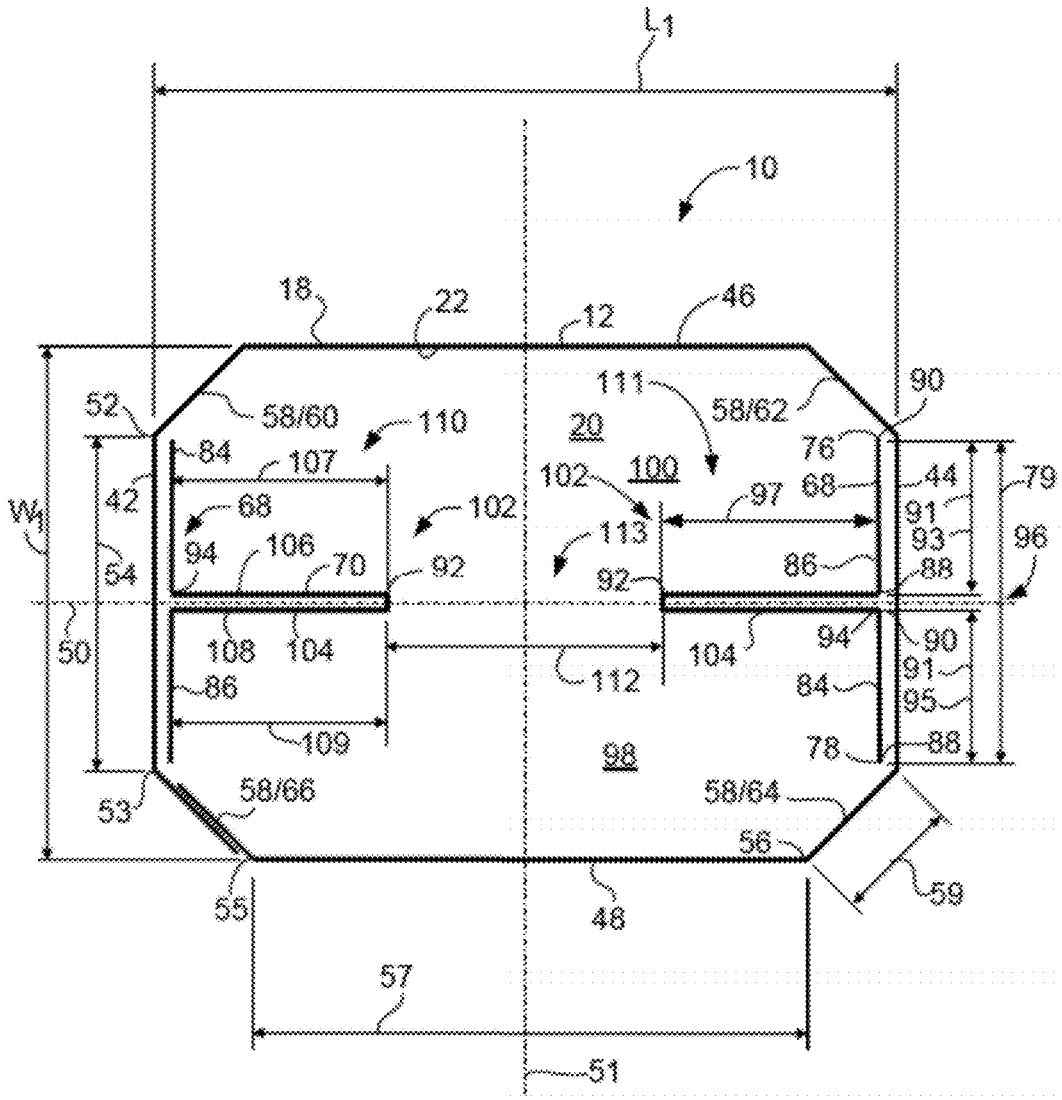
FIG. 2 is a top plan schematic view of the container assembly shown in FIG. 1.
Figure 3:
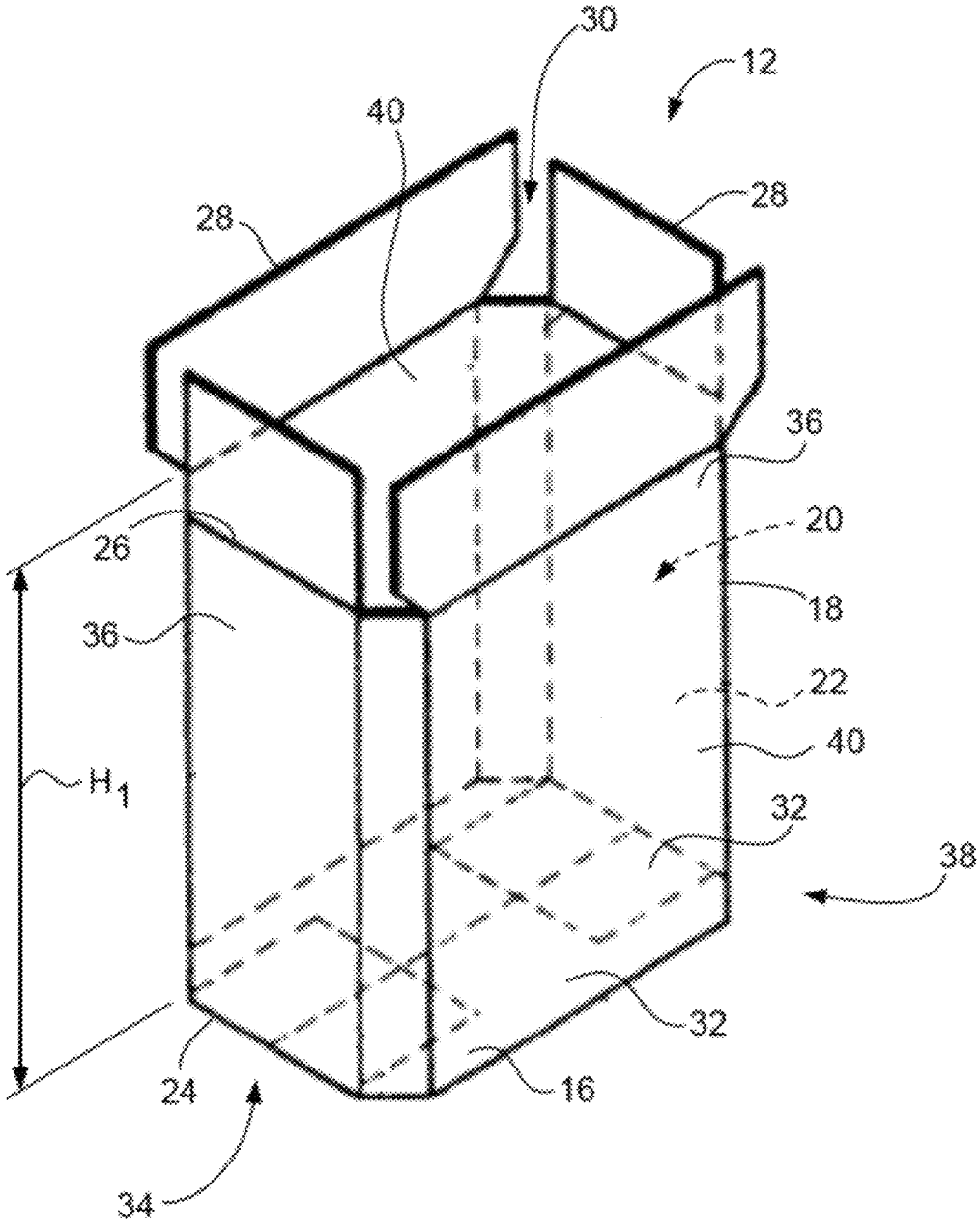
FIG. 3 is a perspective view of an exemplary container that may be used with the container assembly shown in FIG. 1.
Figure 4:
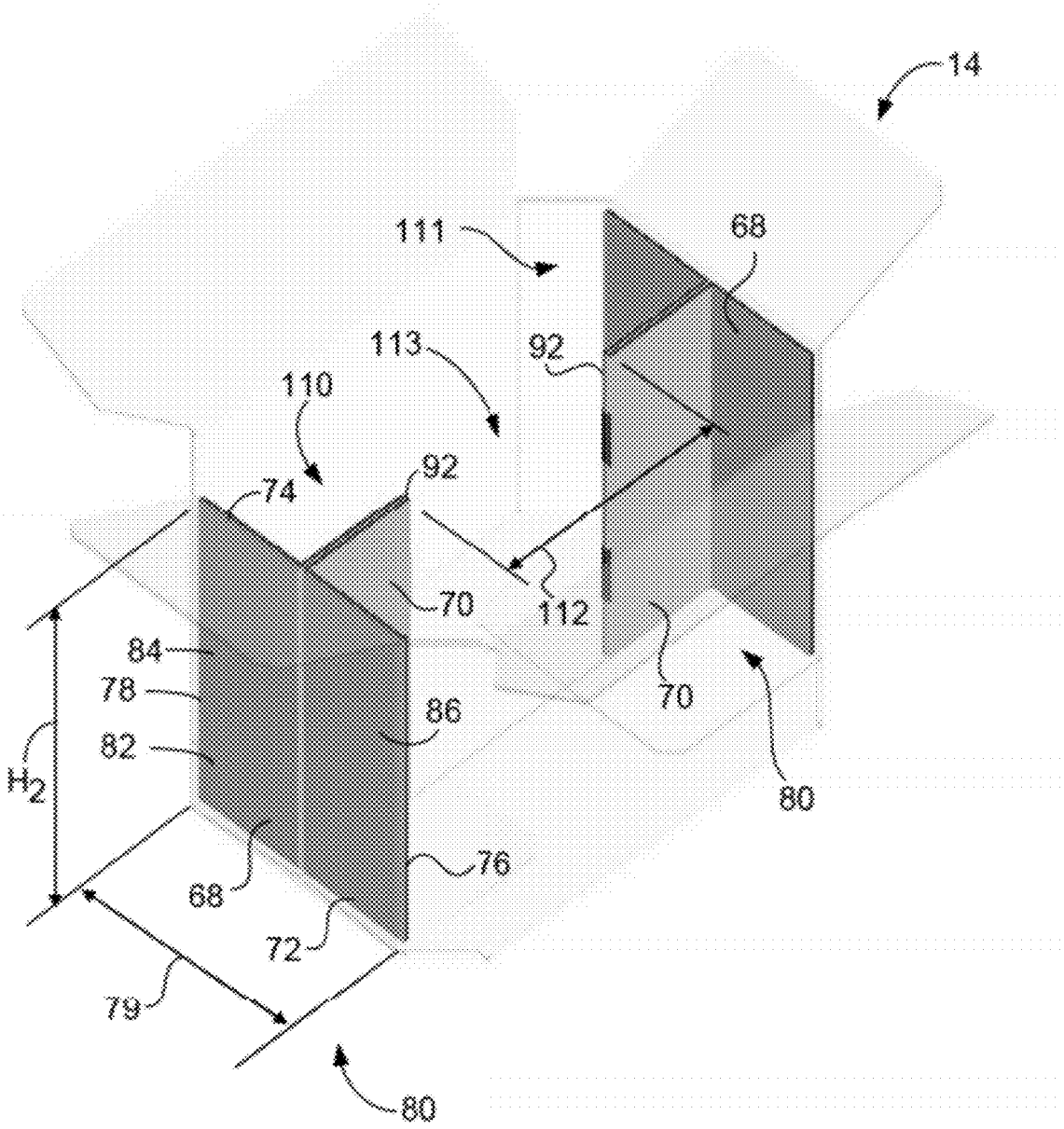
FIG. 4 is a perspective view of an exemplary support assembly that may be used with the container assembly shown in FIG. 1.

FIG. 1 is a perspective view of an exemplary container assembly 10. FIG. 2 is a top plan schematic view of container assembly 10. FIG. 3 is a perspective view of a container 12 that may be used with container assembly 10. FIG. 4 is a perspective view of a support assembly 14 that may be used with container assembly 10. In the exemplary embodiment, container assembly 10 includes container 12 and at least one support assembly 14 positioned within container 12. Container 12 includes a bottom wall 16, and a plurality of sides 18 extending outwardly from bottom wall 16 such that a cavity 20 is defined between bottom wall 16 and sides 18. Each side 18 includes an inner surface 22 that defines cavity 20. Inner surface 22 extends between a bottom edge 24 and a top edge 26. Bottom edge 24 is positioned adjacent bottom wall 16. Top edge 26 extends outwardly from bottom edge 24 such that inner surface 22 includes a height $H_1$ measured between bottom edge 24 and top edge 26.

Container 12 also includes a plurality of top panels 28 that extend outwardly from top edge 26 of sides 18 to define an opening 30 that provides access to cavity 20. Each top panel 28 is foldably connected to one of sides 18 and is selectively rotated with respect to sides 18 to overlap adjacent top panels 28 to selectively form a top wall (not shown) to enclose cavity 20 between bottom wall 16 and the top wall, or to enable access to cavity 20 through opening 30. Bottom wall 16 includes a plurality of bottom panels 32 that extend outwardly from bottom edge 24, and are each foldably coupled to one of sides 18. Each bottom panel 32 overlaps adjacent bottom panels 32 to form bottom wall 16. Alternatively, bottom panels 32 may be folded beneath and/or inside of adjacent bottom panels 32 to form bottom wall 16.

In the exemplary embodiment, container 12 is formed having 8-sides and includes a pair 34 of end walls 36 and a pair 38 of sidewalls 40 extending between end walls 36. More specifically, container 12 includes a first end wall 42, a second opposite end wall 44, a first sidewall 46, and a second opposite sidewall 48. First and second sidewalls 46 and 48 each extend substantially perpendicularly between first and second end walls 42 and 44 such that cavity 20 extends along a longitudinal axis 50 defined between first end wall 42 and second end wall 44. First and second end walls 42 and 44 each extend substantially perpendicularly between first and second sidewalls 46 and 48 such that cavity 20 extends along a transverse axis 51 defined between first sidewall 46 and second sidewall 48. In the exemplary embodiment, container 12 includes a length $L_1$ measured along longitudinal axis 50 defined between first end wall 42 and second end wall 44, and includes a width $W_1$ measured along transverse axis 51 defined between first sidewall 46 and second sidewall 48. In addition, first and second end walls 42 and 44 each include a leading edge 52, a trailing edge 53, and a length 54 measured between leading edge 52 and trailing edge 53 defined along transverse axis 51. Moreover, first and second sidewalls 46 and 48 each extend from a first edge 55 and a second edge 56 along longitudinal axis 50 and include a length 57 measured between first edge 55 and second edge 56 defined along longitudinal axis 50.

Container 12 also includes a plurality of corner walls 58 that extend between each end wall 36 and sidewall 40. Each corner wall 58 includes a length 59 measured between adjacent end walls 36 and sidewalls 40. More specifically, container 12 includes a first corner wall 60 extending between first end wall 42 and first sidewall 46, a second corner wall 62 extending between first sidewall 46 and second end wall 44, a third corner wall 64 extending between second end wall 44 and second sidewall 48, and a fourth corner wall 66 extending between second sidewall 48 and first end wall 42. Each corner wall 58 is oriented obliquely with respect to an adjacent end wall 36 and an adjacent sidewall 40.

In the exemplary embodiment, support assembly 14 includes a back panel assembly 68 and an extension assembly 70 that extends outwardly from back panel assembly 68. Back panel assembly 68 is coupled to container inner surface 22 and includes a lower edge 72, an upper edge 74, and a height $H_2$ measured between lower edge 72 and upper edge 74. In the exemplary embodiment, assembly height $H_2$ is approximately equal to container height $H_1$. Alternatively, assembly height $H_2$ may be greater than, or less than, container height $H_1$. Back panel assembly 68 also extends between a first side edge 76 and a second side edge 78, and has a length 79 measured between first side edge 76 and second side edge 78. Moreover, back panel assembly length 79 is approximately equal to end wall length 54. Alternatively, back panel assembly length 79 may be less than end wall length 54.

In the exemplary embodiment, back panel assembly 68 is oriented with respect to end wall 36 such that lower edge 72 is positioned adjacent bottom edge 24 and bottom wall 16. In an alternative embodiment, back panel assembly 68 may be oriented with respect to end wall 36 such that lower edge 72 is positioned a distance above bottom edge 24 such that a gap (not shown) is defined between back panel assembly 68 and bottom wall 16.

In the exemplary embodiment, back panel assembly 68 includes a pair 80 of back panels 82. More specifically, back panel assembly 68 includes a first back panel 84 and a second back panel 86 that are each coupled to container inner surface 22 in a face-to-face relationship with end wall 36. Moreover, first and second back panels 84 and 86 each extend outwardly from extension assembly 70 in opposite directions. In the exemplary embodiment, first and second back panels 84 and 86 each include a first edge 88, a second edge 90, and a length 91 measured between first edge 88 and second edge 90. In the exemplary embodiment, first back panel 84 includes a length 93 that is approximately equal to a length 95 of second back panel 86. Alternatively, first back panel length 93 may be greater than, or less than, second back panel length 95.

Extension assembly 70 is oriented substantially perpendicular to back panel assembly 68 and extends into cavity 20 along transverse axis 51. Moreover, back panel assembly 68 is coupled to first end wall 42 such that extension assembly 70 extends outwardly from back panel assembly 68 towards second end wall 44. Extension assembly 70 includes a leading edge 92, an opposite trailing edge 94 positioned adjacent back panel assembly 68, and a length 97 measured between leading edge 92 and trailing edge 94 defined along longitudinal axis 50. In the exemplary embodiment, extension assembly length 97 is greater than back panel assembly length 79. Alternatively, extension assembly length 97 may be less than, or approximately equal to, back panel assembly length 79. In the exemplary embodiment extension assembly 70 extends outwardly from back panel assembly 68 at a midpoint 96 along back panel assembly length 79 such that extension assembly 70 substantially bisects cavity 20 into a first cavity portion 98 and a second cavity portion 100 that is approximately equal to first cavity portion 98. Alternatively, extension assembly 70 may be positioned at any location along back panel assembly length 79 such that first cavity portion 98 is smaller than, or larger than, second cavity portion 100.

In the exemplary embodiment, extension assembly 70 includes a pair 102 of extension panels 104 that extend substantially perpendicularly from first and second back panels 84 and 86. More specifically, extension assembly 70 includes a first extension panel 106 and second extension panel 108 that is oriented substantially parallel to first extension panel 106, and oriented in a face-to-face relationship with first extension panel 106. First extension panel 106 includes a length 107 that is approximately equal to a length 109 of second extension panel 108. Alternatively, first extension panel length 107 may be greater than, or less than, second extension panel length 109.

In the exemplary embodiment, container assembly 10 includes a first support assembly 110 and a second support assembly 111. First support assembly 110 is coupled to first end wall 42. Second support assembly 111 is coupled to second end wall 44 and is oriented in an opposing relationship with first support assembly 110. In addition, second support assembly 111 is spaced a distance 112 from first support assembly 110 along longitudinal axis 50 such that a gap 113 is defined between opposite extension assemblies 70. In the exemplary embodiment, first and second support assemblies 110 and 111 each have a substantially similar shape. Alternatively, first and second support assemblies 110 and 111 may each have a different shape.

Figure 5:
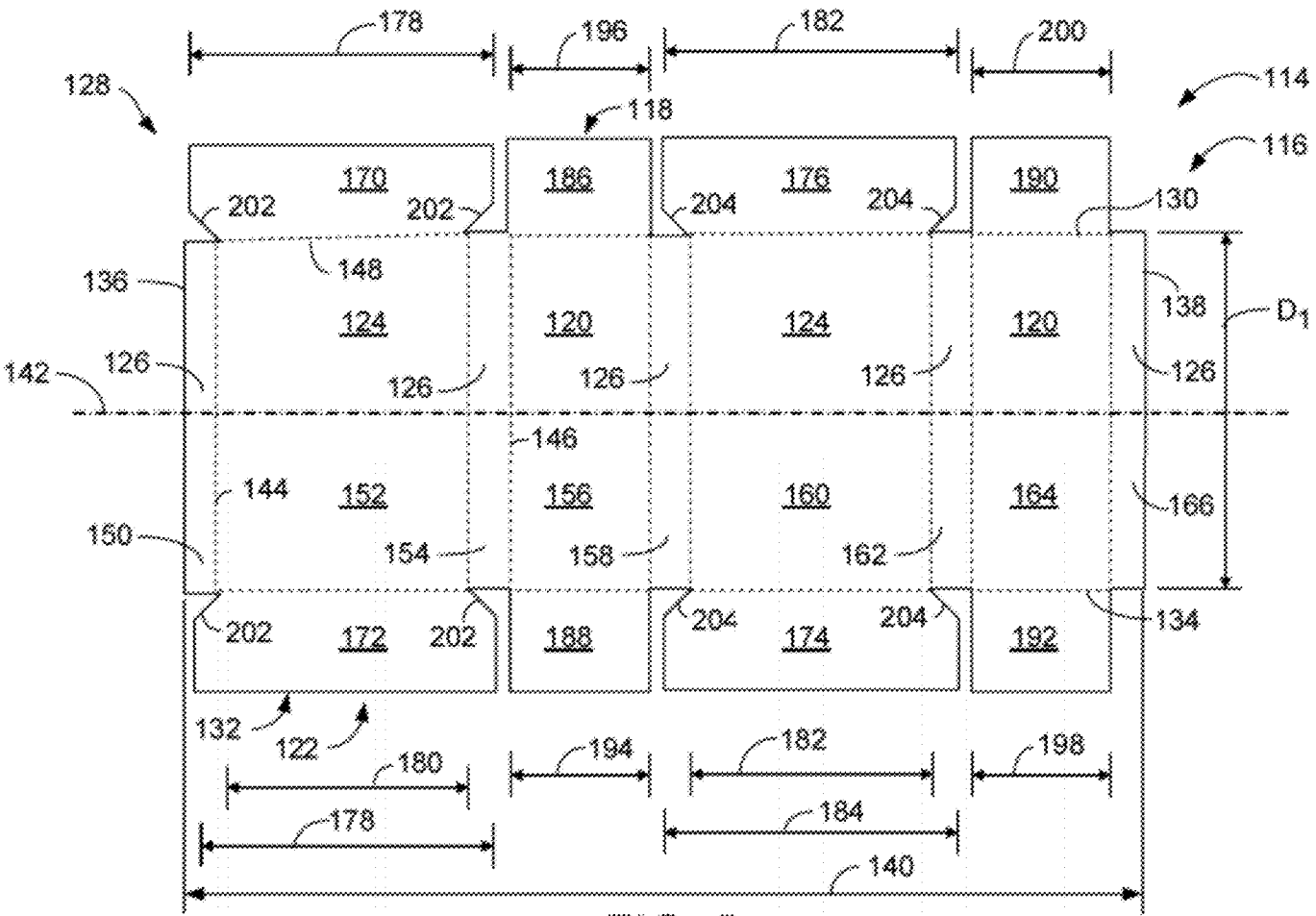
FIG. 5 is a top plan view of an exemplary blank of sheet material that may be used to form the container shown in FIG. 3.

FIG. 5 is a top plan view of an exemplary embodiment of a blank 114 of sheet material that may be used to form container 12. In the exemplary embodiment, blank 114 includes a plurality of panels 116 that are each sized and shaped to facilitate forming container 12 having 8-sides and including corner walls that are obliquely angled with respect to, and interconnect with, sidewalls and end walls, such that container 12 includes a substantially octagon cross-sectional shape.

In the exemplary embodiment, blank 114 includes a pair 118 of end wall panels 120, a pair 122 of side panels 124, and a plurality of corner panels 126. In addition, blank 114 includes a plurality of top wall panels 128 that extend outwardly from a top edge 130 of each end and side panels 120 and 124, and a plurality of bottom wall panels 132 that extend outwardly from a bottom edge 134 of each end and side panels 120 and 124.

Blank 114 extends between top edge 130 and bottom edge 134 and has a depth $D_1$ that is defined as the height of end wall panels 120, side panels 124, and corner panels 126. In addition, blank 114 extends between a first free edge 136 and a second free edge 138 and has a length 140 measured from first free edge 136 to second free edge 138 defined along a central axis 142.

Adjacent panels 116 are connected together by a plurality of preformed fold lines 144. More specifically, end wall panels 120, side panels 124 and corner panels 126 are foldably connected together with a plurality of preformed, generally parallel, first fold lines 146. Top wall panels 128 and bottom wall panels 132 are foldably coupled to end and side panels 120 and 124 with a plurality of preformed second fold lines 148 that are oriented substantially perpendicularly to first fold lines 146.

In the exemplary embodiment, blank 114 includes, in series, a first corner panel 150, a first side panel 152, a second corner panel 154, a first end wall panel 156, a third corner panel 158, a second side panel 160, a fourth corner panel 162, a second end wall panel 164, and a glue panel 166. A first top side panel 170 and a first bottom side panel 172 extend outwardly from opposing edges of first side panel 152. Similarly, a second bottom side panel 174 and a second top side panel 176 extend from opposing edges of second side panel 160. First bottom side panel 172 and first top side panel 170 each have a width 178 taken along central axis 142 of blank 114 that is greater than a width 180 of first side panel 152, also taken along central axis 142. Similarly, second bottom side panel 174 and second top side panel 176 each have a width 182 that is greater than a width 184 of second side panel 160, taken along central axis 142.

In addition, a first top end panel 186 and a first bottom end panel 188 extend from opposing edges of first end wall panel 156. Similarly, a second bottom end panel 190 and a second top end panel 192 extend from opposing edges of second end wall panel 164. First bottom end panel 188 and first top end panel 186 each have a width 194 taken along central axis 142 of blank 114 that is substantially equal to a width 196 of first end wall panel 156. Similarly, second bottom end panel 190 and second top end panel 192 each have a width 198 that is substantially equal to a width 200 of second end wall panel 164.

In the exemplary embodiment, bottom side panels 172 and 174 and top side panels 170 and 176 each include opposing angled edge portions 202 and 204 that are each obliquely angled with respect to second fold lines 148. Although other angles may be used without departing from the scope of the present invention, in one embodiment, edge portions 202 and 204 are angled at about 45° with respect to second fold lines 148.

Figure 6:
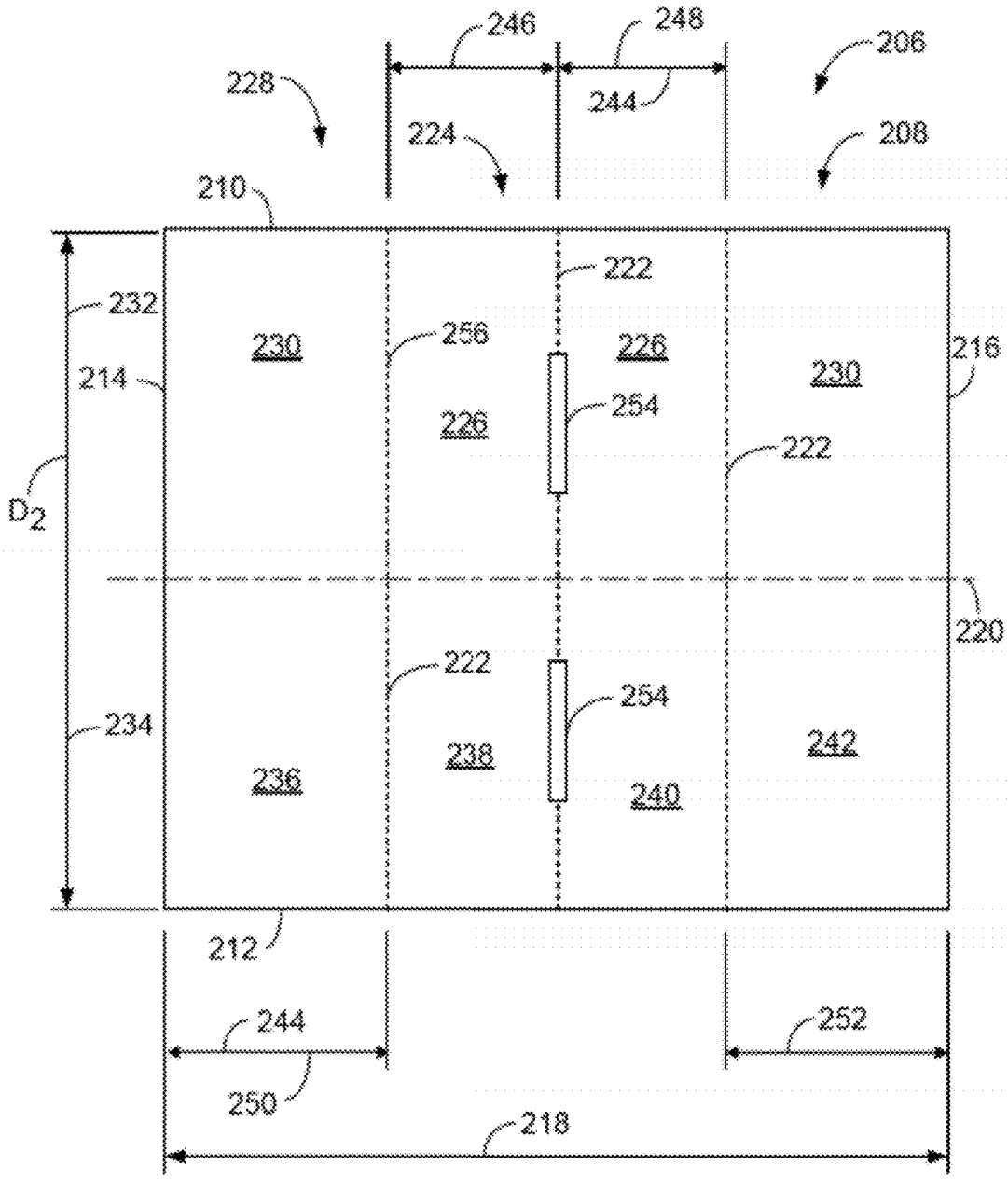
FIG. 6 is a top plan view of an exemplary blank of sheet of material that may be used to form the support assembly shown in FIG. 4.

FIG. 6 is a top plan view of an exemplary embodiment of a blank 206 of sheet material that may be used to form support assembly 14. In the exemplary embodiment, blank 206 includes a plurality of panels 208 that are each sized and shaped to facilitate forming support assembly 14 including extension assembly 70 extending substantially perpendicularly from back panel assembly 68. Blank 206 extends between a top edge 210 and a bottom edge 212, and has a depth $D_2$ that is defined as height $H_2$ of support assembly 14. In addition, blank 206 extends between a first free edge 214 and a second free edge 216, and has a width 218 measured from first free edge 214 to second free edge 216, and defined along a centerline axis 220. Adjacent panels 208 are foldably connected together by a plurality of preformed, generally parallel, fold lines 222.

In the exemplary embodiment, blank 206 includes a pair 224 of extension panels 226 that form extension assembly 70, and a pair 228 of back panels 230 that form back panel assembly 68. In the exemplary embodiment, each extension panel 226 includes a depth 232 that is approximately equal to blank depth $D_2$. Alternatively, extension panel depth 232 may be less than, or greater than, blank depth $D_2$. Similarly, each back panel 230 includes a depth 234 that is approximately equal to blank depth $D_2$. In an alternative embodiment, back panel depth 234 may be less than, or greater than, blank depth $D_2$ and/or extension panel depth 232.

Blank 206, in the exemplary embodiment, includes a first back panel 236 and a first extension panel 238 that is connected to first back panel 236. A second extension panel 240 is connected to first extension panel 238 such that first extension panel 238 is positioned between second extension panel 240 and first back panel 236. A second back panel 242 is connected to second extension panel 240 such that second extension panel 240 is positioned between second back panel 242 and first extension panel 238.

In the exemplary embodiment, each panel 208 also includes a width 244 measured along centerline axis 220. A first extension panel width 246 is approximately equal to a second extension panel width 248. Alternatively, first extension panel width 246 may be less than, or greater than, second extension panel width 248. In addition, a first back panel width 250 is approximately equal to a second back panel width 252. Alternatively, first back panel width 250 may be less than, or greater than, second back panel width 252. In the exemplary embodiment, each first and second extension panel widths 246 and 248 is less than first and second back panel widths 250 and 252. In an alternative embodiment, each first and second extension panel widths 246 and 248 is greater than, or approximately equal to, first and second back panel widths 250 and 252.

In an alternative embodiment, blank 206 includes one or more openings 254 that extend through blank 206 and are defined between first extension panel 238 and second extension panel 240. Each opening 254 is sized and shaped to facilitate folding first extension panel 238 towards second extension panel 240 along fold line 222 to form support assembly 14.

In one embodiment, blank 206 includes a plurality of folding members 256 (shown in FIGS. 6, 9, and 12) that extend between each panel 208. Each folding member 256 extends between top edge 210 and bottom edge 212 and is pivotably connected between adjacent panels 208 to enable each panel 208 to pivot with respect to an adjacent panel 208.

Figure 7:
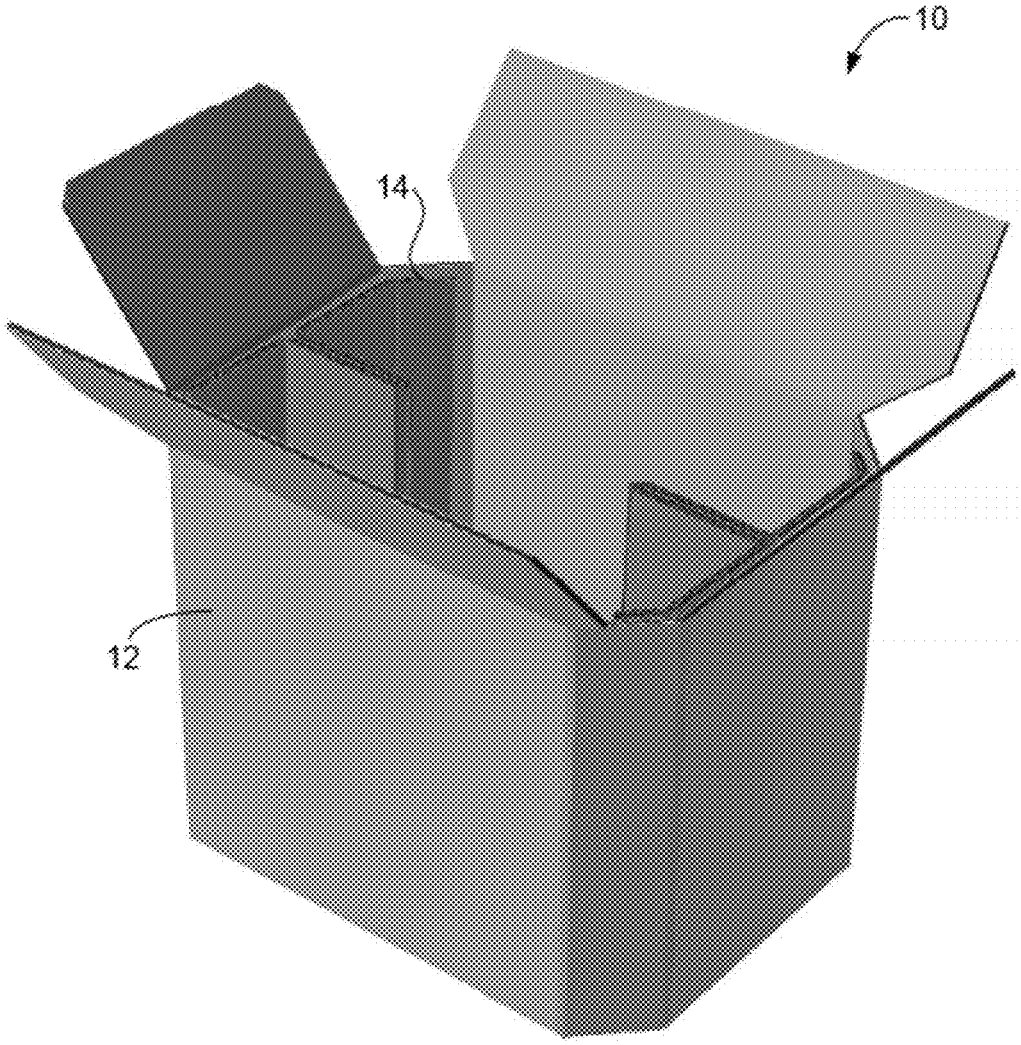
FIG. 7 is a perspective view of an alternative embodiment of the container assembly shown in FIG. 1.
Figure 8:
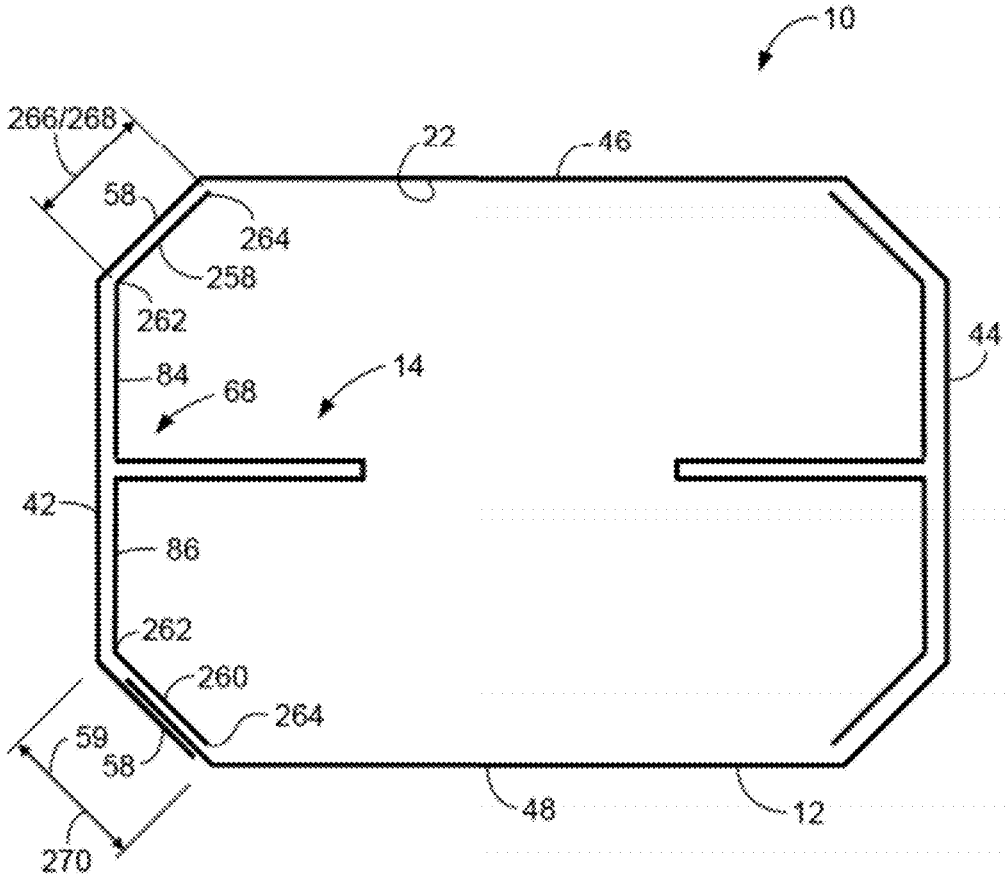
FIG. 8 is a top plan schematic view of the container assembly shown in FIG. 7.
Figure 9:
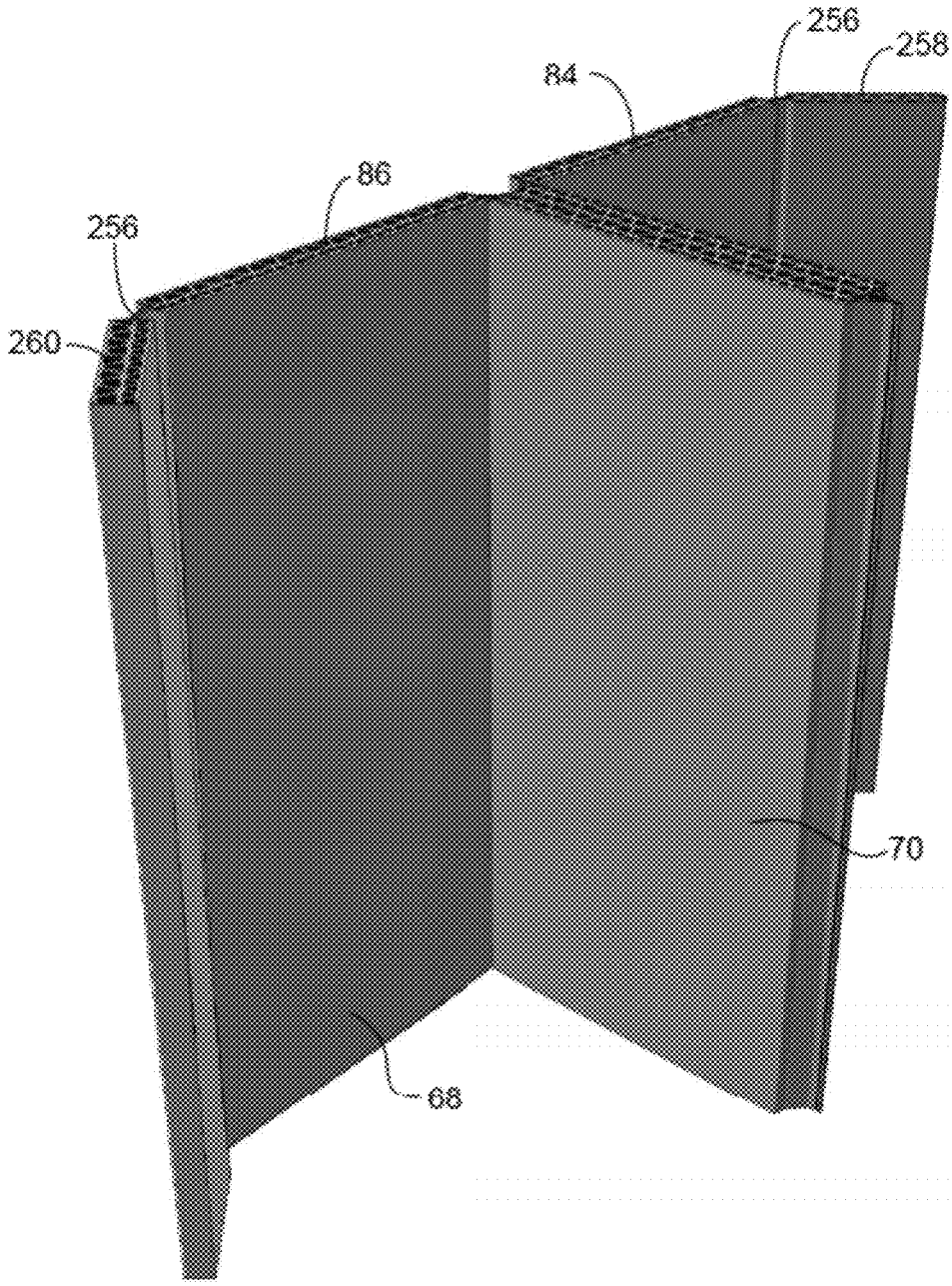
FIG. 9 is a perspective view of a support assembly that may be used with the container assembly shown in FIG. 7.
Figure 10:
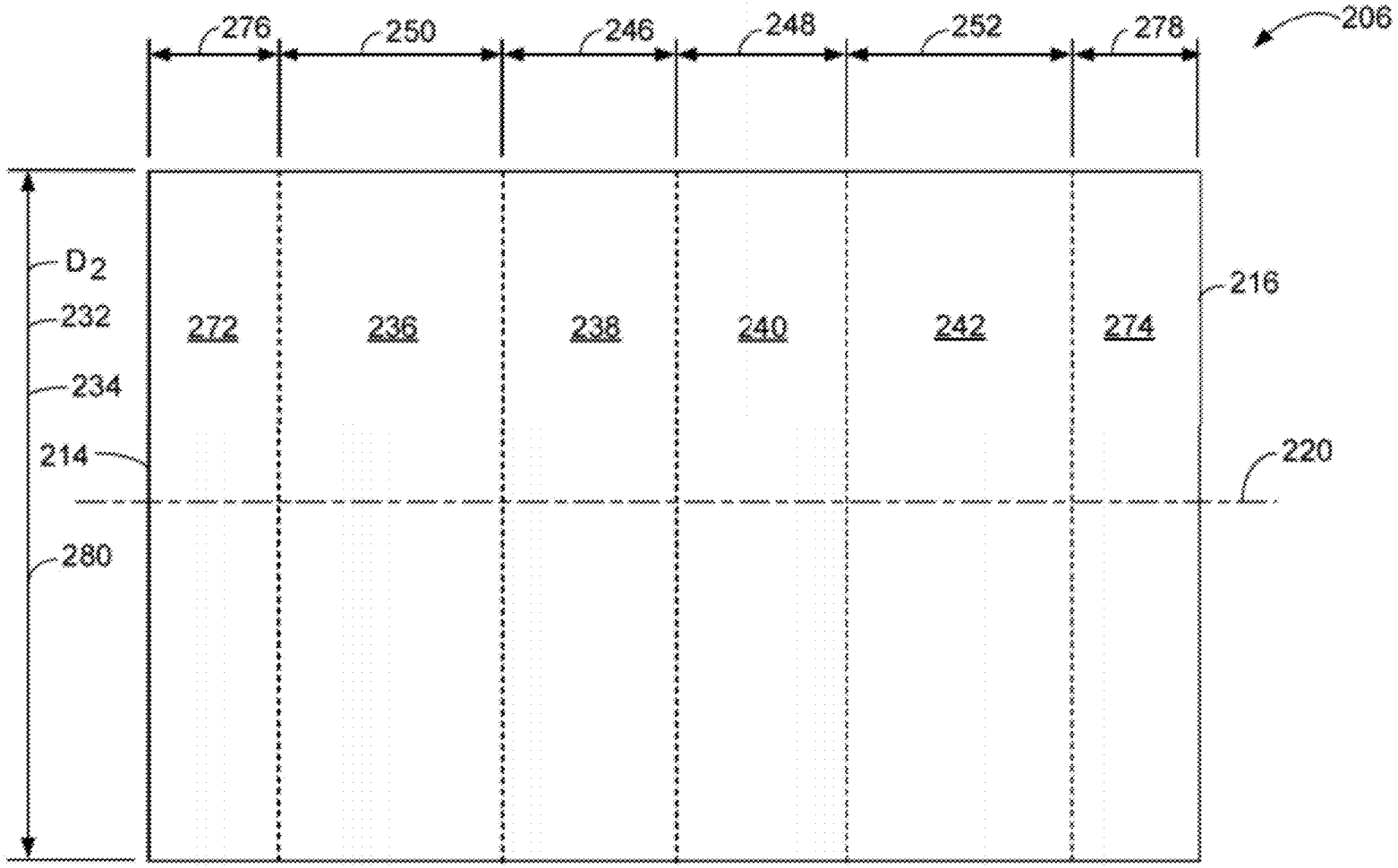
FIG. 10 is a top plan view of a blank of sheet material that may be used to form the support assembly shown in FIG. 9.

FIG. 7 is a perspective view of an alternative embodiment of container assembly 10. FIG. 8 is a top plan schematic view of container assembly 10 shown in FIG. 7. FIG. 9 is a perspective view of an alternative embodiment of support assembly 14. FIG. 10 is a top plan view of an alternative embodiment of blank 206 that may be used to form support assembly 14 shown in FIG. 9. Identical components shown in FIGS. 7-9 are labeled with the same reference numbers used in FIGS. 1-6. Identical components shown in FIG. 10 are labeled with the same reference numbers used in FIG. 5. In an alternative embodiment, back panel assembly 68 includes a first corner panel 258 that extends outwardly from first back panel 84, and a second corner panel 260 that extends outwardly from second back panel 86. First and second corner panels 258 and 260 each extend obliquely outwardly from first and second back panels 84 and 86, respectively, and extend across an inner surface of corresponding corner walls 58. Moreover, first and second corner panels 258 and 260 are coupled to container inner surface 22 in a face-to-face relationship with corresponding corner walls 58. In this embodiment, first and second corner panels 258 and 260 each include a first edge 262, a second edge 264, and a length 266 measured between first edge 262 and second edge 264. In one embodiment, first corner panel 258 includes a length 268 that is approximately equal to a length 270 of second corner panel 260. Alternatively, first corner panel length 268 may be greater than, or less than, second corner panel length 270. In one embodiment, first and second corner panel lengths 268 and 270 are approximately equal to corner wall length 59. In another embodiment, first and second corner panel lengths 268 and 270 are less than corner wall length 59.

In an alternative embodiment, blank 206 includes a first corner panel 272 and a second corner panel 274. First corner panel 272 is connected to first back panel 236 such that first back panel 236 is between first corner panel 272 and first extension panel 238. Second corner panel 274 is connected to second back panel 242 such that second back panel 242 is between second corner panel 274 and second extension panel 240. First corner panel 272 includes a width 276 measured between first free edge 214 and first back panel 236. Second corner panel 274 includes a width 278 measured between second back panel 242 and second free edge 216.

In one embodiment, first corner panel width 276 is approximately equal to second corner panel width 278. Alternatively, first corner panel width 276 may be less than, or greater than, second corner panel width 278. In another embodiment, first and second corner panel widths 276 and 278 are less than first and second back panel widths 250 and 252, and less than first and second extension panel widths 246 and 248. Alternatively, first and second corner panel widths 276 and 278 may be greater than, or approximately equal to, first and second back panel widths 250 and 252, and/or first and second extension panel widths 246 and 248. In the exemplary embodiment, each corner panel 272 and 274 includes a depth 280 that is approximately equal to blank depth $D_2$. Alternatively, corner panel depth 280 may be less than, or greater than, blank depth $D_2$, extension panel depth 232, and/or back panel depth 234.

Figure 11:
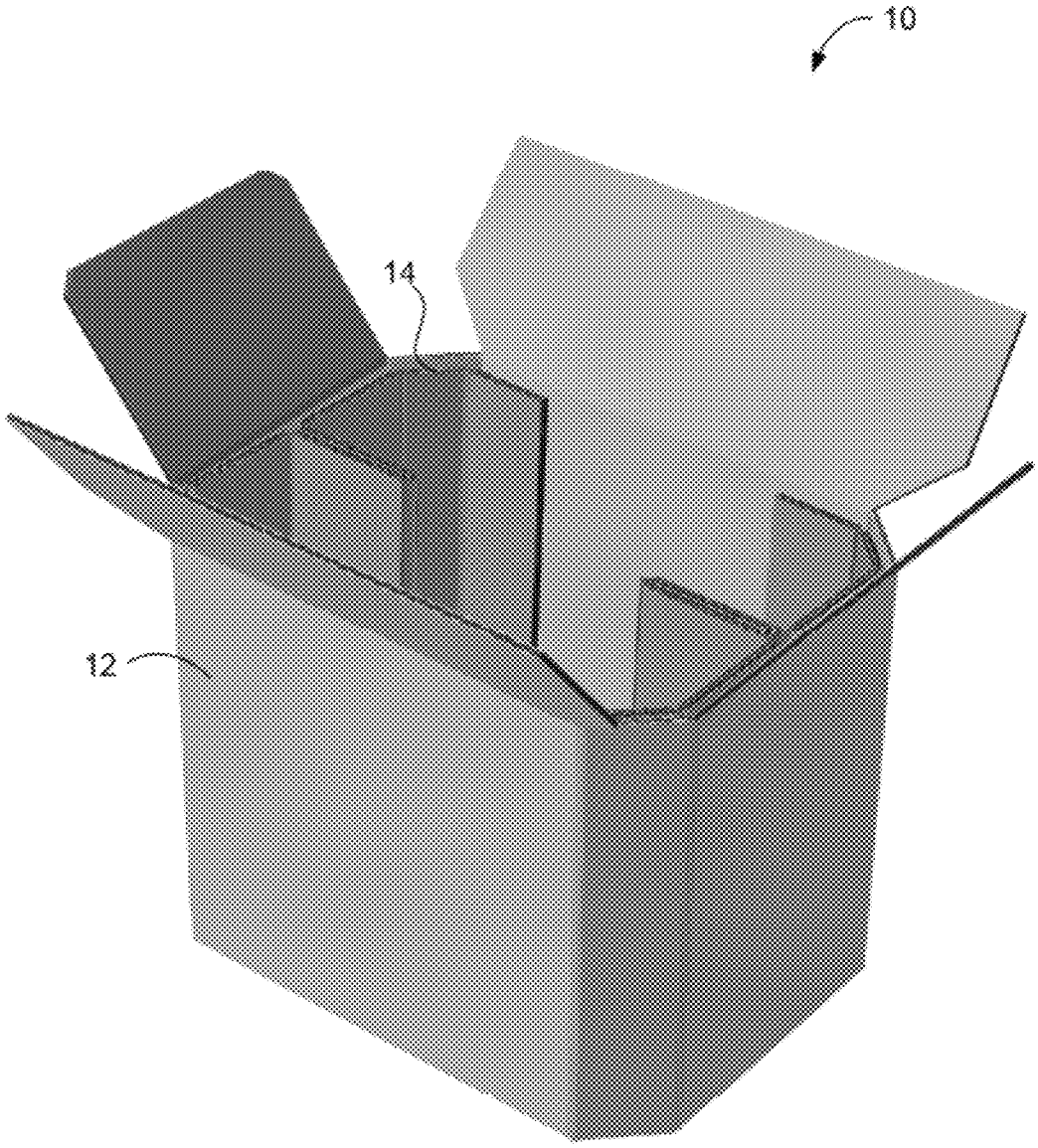
FIG. 11 is a perspective view of another alternative embodiment of the container assembly shown in FIG. 1.
Figure 12:
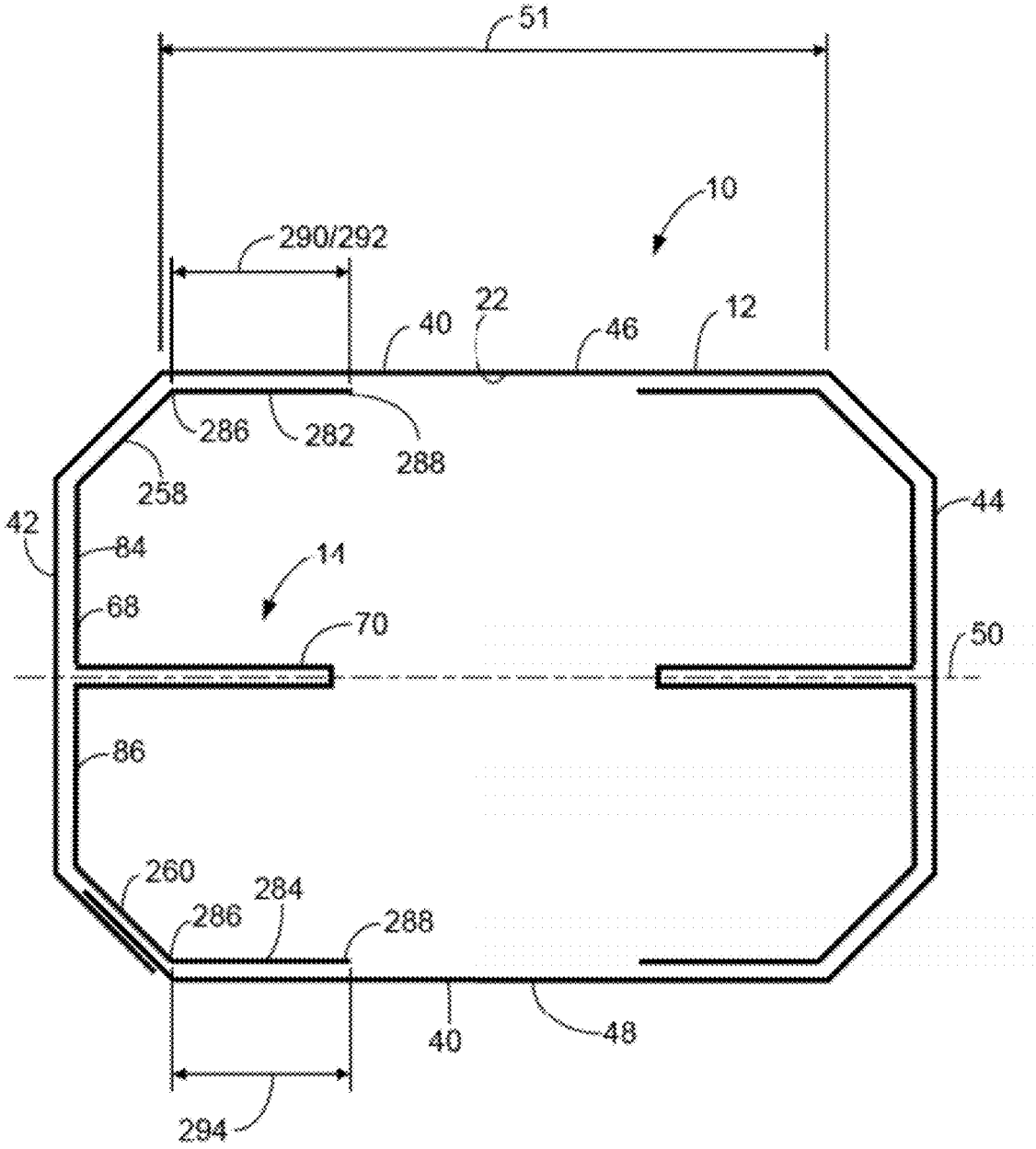
FIG. 12 is a top plan schematic view of the container assembly shown in FIG. 11.
Figure 13:
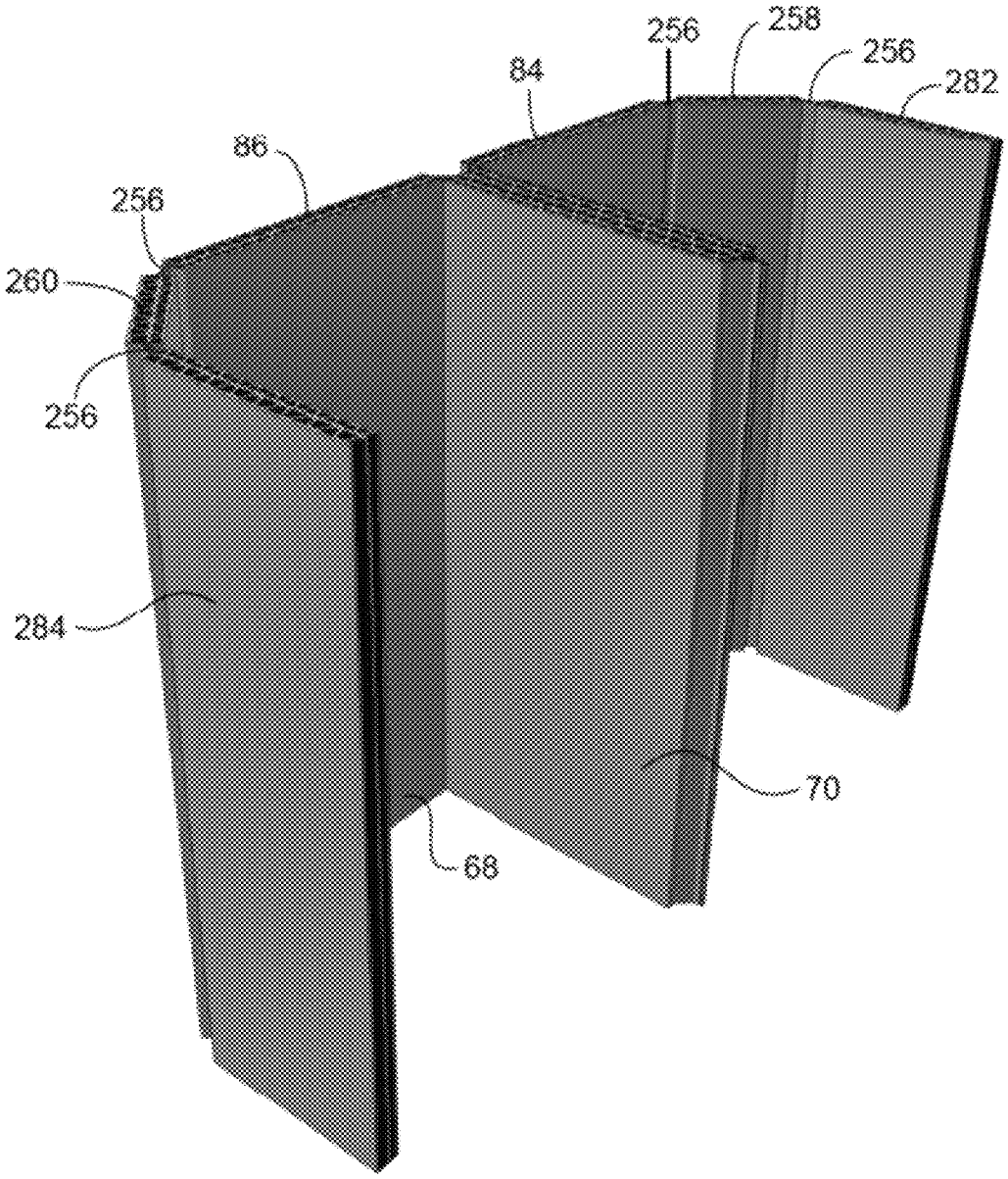
FIG. 13 is a perspective view of a support assembly that may be used with the container assembly shown in FIG. 11.
Figure 14:
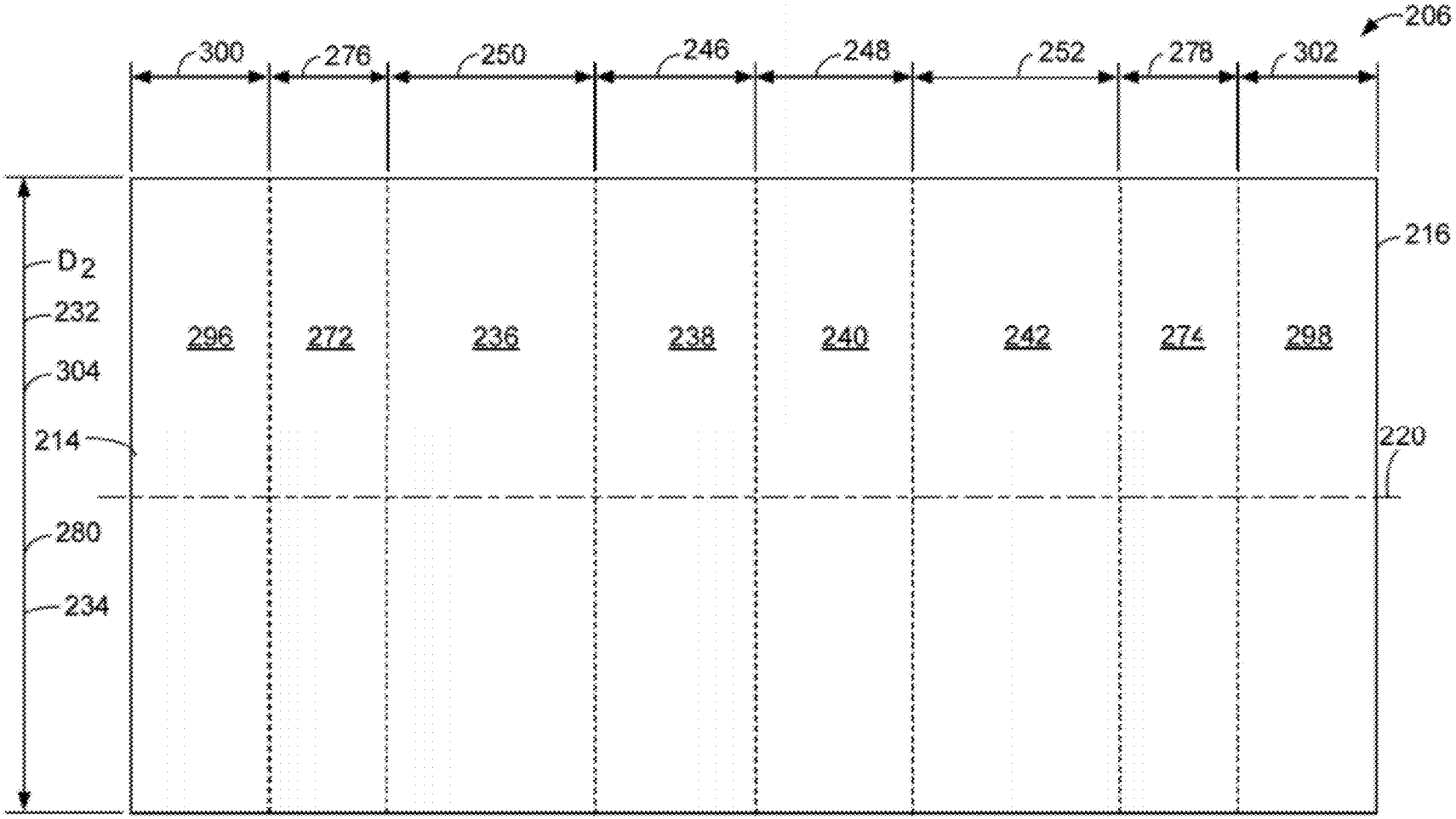
FIG. 14 is a top plan view of a blank of sheet material that may be used to form the support assembly shown in FIG. 13.

FIG. 11 is a perspective view of another alternative embodiment of container assembly 10. FIG. 12 is a top plan view of container assembly 10 shown in FIG. 11. FIG. 13 is a perspective view of an alternative support assembly 14. FIG. 14 is a top plan view of an alternative embodiment of blank 206 that may be used to form support assembly 14 shown in FIG. 13. Identical components shown in FIGS. 11-13 are labeled with the same reference numbers used in FIGS. 7-10. Identical components shown in FIG. 14 are labeled with the same reference numbers used in FIG. 10. In an alternative embodiment, back panel assembly 68 includes a first sidewall panel 282 that extends outwardly from first corner panel 258, and a second sidewall panel 284 that extends outwardly from second corner panel 260. First and second sidewall panels 282 and 284 are oriented substantially perpendicularly to back panels 84 and 86 along longitudinal axis 50, and extend across inner surface 22 of corresponding sidewalls 40. Moreover, first and second sidewall panels 282 and 284 are coupled to container inner surface 22 in a face-to-face relationship with corresponding sidewalls 40. In one embodiment, support assembly 14 does not include corner panels 258 and 260, and sidewall panels 282 and 284 are connected to back panels 84 and 86, respectively.

In the exemplary embodiment, first and second sidewall panels 282 and 284 each include a first edge 286, a second edge 288, and a length 290 measured between first edge 286 and second edge 288. In one embodiment, first sidewall panel 282 includes a length 292 that is approximately equal to a length 294 of second sidewall panel 284. Alternatively, first sidewall panel length 292 may be greater than, or less than, second sidewall panel length 294. In one embodiment, first and second sidewall panel lengths 292 and 294 are less than a length 57 of sidewall 40. In another embodiment, first and second sidewall panel lengths 292 and 294 are approximately equal to sidewall length 57.

In an alternative embodiment, blank 206 includes a first sidewall panel 296 and a second sidewall panel 298. First sidewall panel 296 is connected to first corner panel 272 such that first corner panel 272 is between first sidewall panel 296 and first back panel 236. Second sidewall panel 298 is connected to second corner panel 274 such that second corner panel 274 is between second sidewall panel 298 and second back panel 242. First sidewall panel 296 includes a width 300 measured between first free edge 214 and first corner panel 272. Second sidewall panel 298 includes a width 302 measured between second corner panel 274 and second free edge 216. In one embodiment, first sidewall panel width 300 is approximately equal to second sidewall panel width 302. Alternatively, first sidewall panel width 300 may be less than, or greater than, second sidewall panel width 302. In one embodiment, first and second sidewall panel widths 300 and 302 are less than first and second back panel widths 250 and 252, and less than first and second extension panel widths 246 and 248. Alternatively, first and second sidewall panel widths 300 and 302 may be greater than, or approximately equal to, back panel widths 250 and 252, extension panel widths 246 and 248, and/or corner panel widths 276 and 278.

In the exemplary embodiment, each sidewall panel 296 and 298 includes a depth 304 that is approximately equal to blank depth $D_2$. Alternatively, sidewall panel depths 304 may be less than, or greater than, blank depth $D_2$, corner panel depth 280, extension panel depth 232, and/or back panel depth 234. In addition, each sidewall panel 296 and 298 may have a different depth 304.

Figure 15:
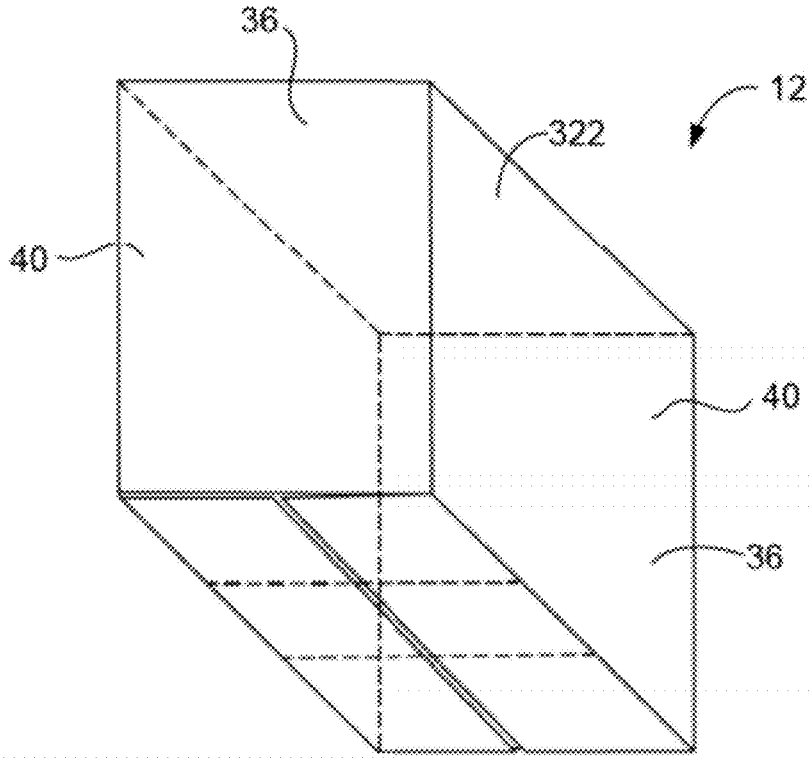
FIG. 15 is a perspective view of an alternative embodiment of the container shown in FIG. 3.
Figure 16:
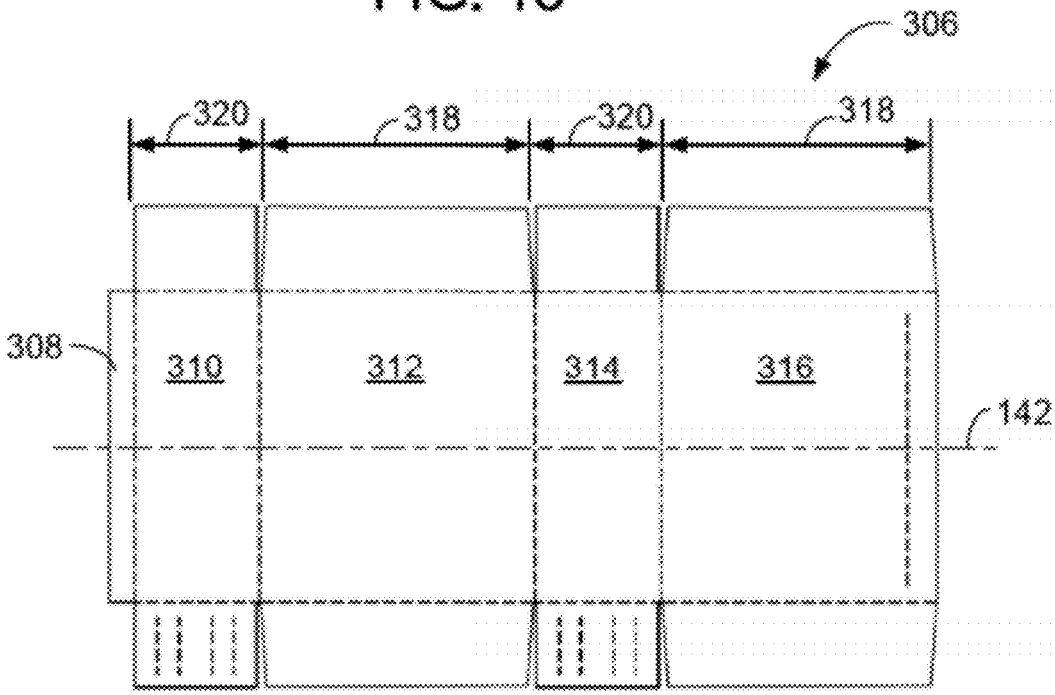
FIG. 16 is a top plan view of a blank of sheet material that may be used to form the container shown in FIG. 15.

FIG. 15 is a perspective view of an alternative embodiment of container 12. FIG. 16 is a top plan view of a blank 306 sheet of material that may be used to form container 12 shown in FIG. 15. Identical components shown in FIG. 15 are labeled with the same reference numbers used in FIG. 3. Identical components shown in FIG. 16 are labeled with the same reference numbers used in FIG. 5. In an alternative embodiment, container 12 does not include corner walls 58, and sidewalls 40 are coupled to end walls 36 to form container 12 having 4-sides and a substantially rectangular cross-sectional shape.

In one embodiment, blank 306 includes, in series, a glue panel 308, a first end wall panel 310, a first side panel 312, a second end wall panel 314, and a second side panel 316. First side panel 312 and second side panel 316 each have a width 318 taken along central axis 142 that is greater than a width 320 of first end wall panel 310 and second end wall panel 314. In the exemplary embodiment, each panel 308, 310, 312, 314, and 316 is folded towards an adjacent panel 308, 310, 312, 314, and 316 such that second side panel 316 is coupled to glue panel 308 to form container 12. Bottom side panels 172 and 174 and bottom end panels 188 and 190 are folded inwardly to form bottom wall 16. Similarly, top side panels 170 and 176 and top end panels 186 and 192 are folded inwardly to form a top cover 322.

Figure 17:
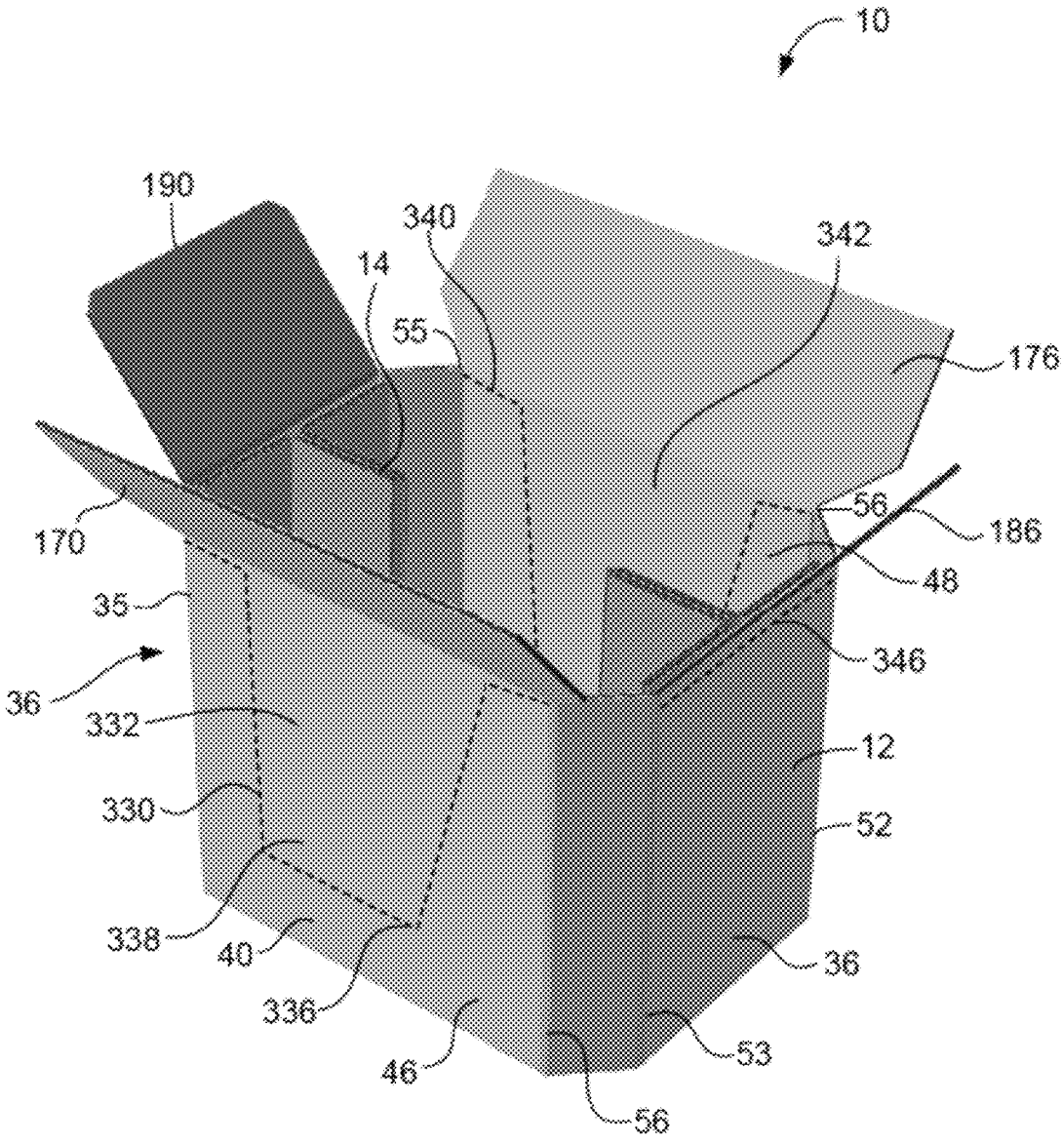
FIG. 17 is a perspective view of another alternative embodiment of the container assembly shown in FIG. 1.
Figure 18:
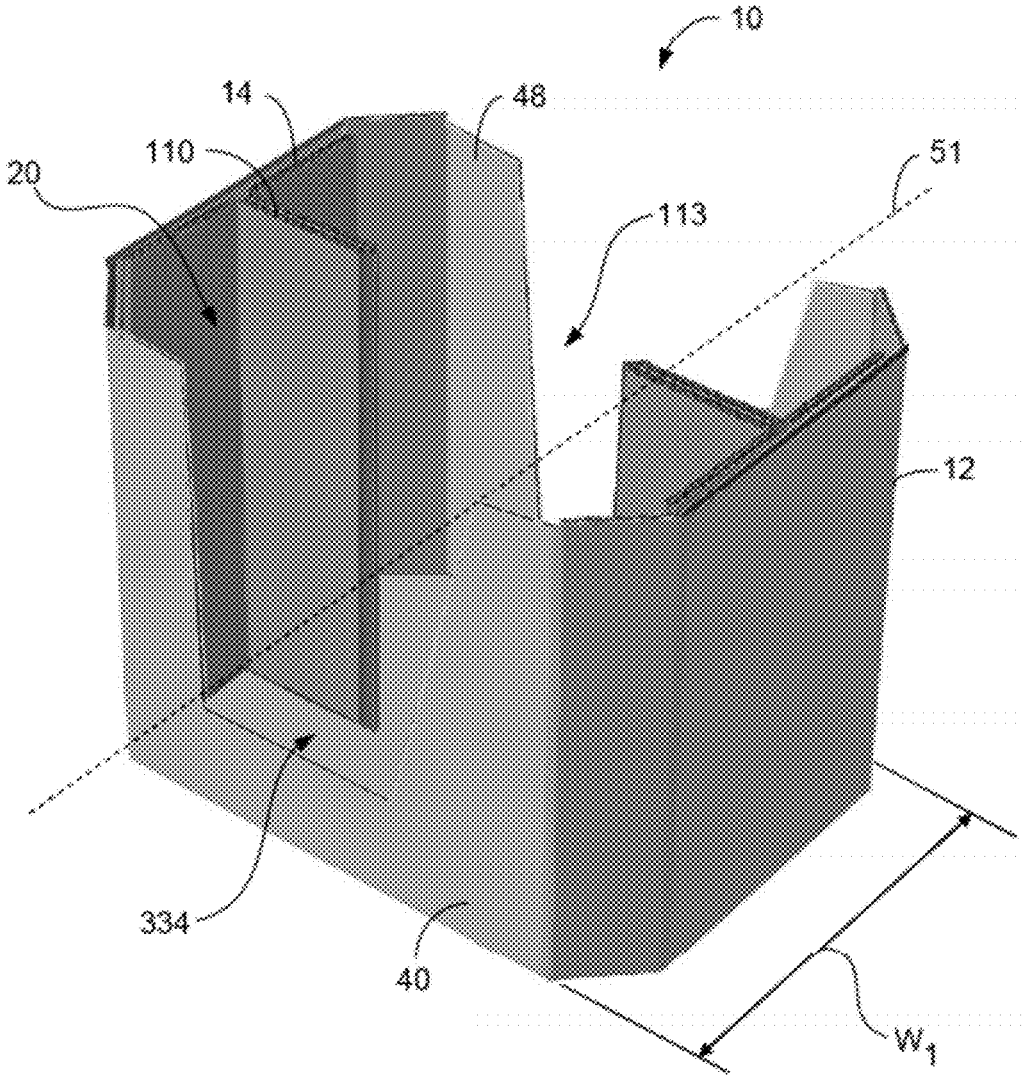
FIG. 18 is a perspective view of the container assembly shown in FIG. 17 with a portion of the sidewalls removed.
Figure 19:
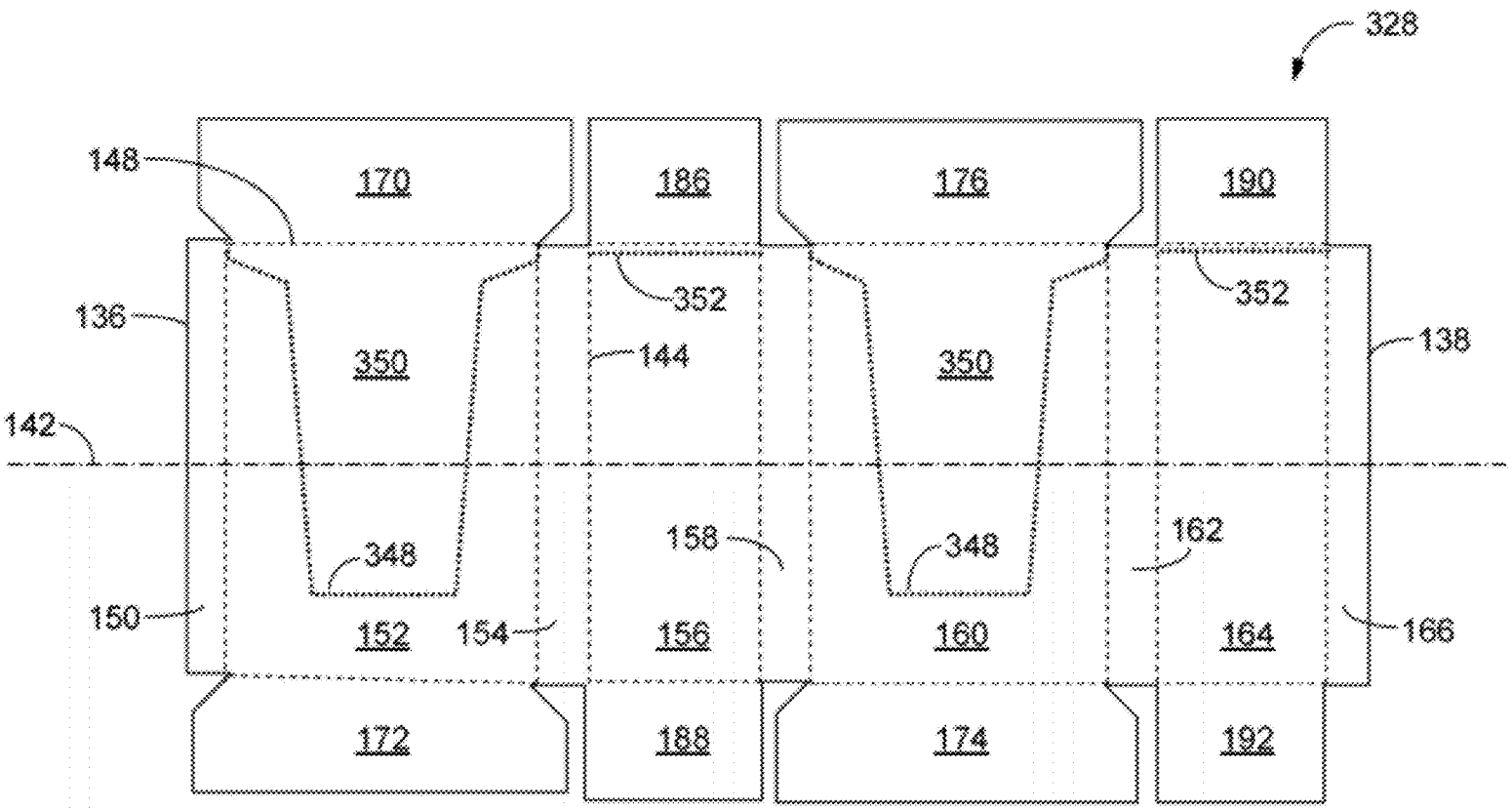
FIG. 19 is a top plan view of a blank of sheet material that may be used to form the container shown in FIG. 17.

FIG. 17 is a perspective view of another alternative embodiment of container assembly 10. FIG. 18 is a perspective view of container assembly 10 shown in FIG. 17 with portions of sidewalls 40 removed. FIG. 19 is a top plan view of a blank 328 of sheet material that may be used to form container 12 shown in FIG. 17. Identical components shown in FIGS. 17 and 18 are labeled with the same reference numbers used in FIGS. 1-3. Identical components shown in FIG. 19 are labeled with the same reference numbers used in FIG. 5. In an alternative embodiment, at least one sidewall 40 includes at least one sidewall perforation 330 extending through sidewall 40 to define a removable sidewall portion 332. In the exemplary embodiment, sidewall perforation 330 is substantially linear. Alternatively, sidewall perforation 330 may include at least one portion that is arcuate. In the exemplary embodiment, removable sidewall portion 332 is configured to be removed from sidewall 40 along sidewall perforation 330 such that an opening 334 extends through sidewall 40. Removable sidewall portion 332 is sized and shaped to define opening 334 having a size and shape that enables a customer to view products (not shown) stored within container 12, and to remove one or more products from container 12. Alternatively, removable sidewall portion 332 may have any size or shape to enable a customer to view, access, remove, or replace any number of products within container 12.

In the exemplary embodiment, first sidewall 46 includes a first sidewall perforation 336 that defines a first removable sidewall portion 338. Second sidewall 48 includes a second sidewall perforation 340 that defines a second removable sidewall portion 342. First and second removable sidewall portion 340 and 342 are configured to be removed first and second sidewalls 46 and 48, respectively, such that opening 334 that extends through cavity 20 along transverse axis 51 from first sidewall 46 to second sidewall 48. In addition, first support assembly 110 is oriented with respect to second support assembly 111 such that gap 113 is sized and shaped to enable a customer to access products along the full width $W_1$ of container 12 through opening 334.

In one embodiment, first removable sidewall portion 338 extends from first edge 55 to second edge 56 and is connected to first top side panel 170 such that removing first removable sidewall portion 338 from first sidewall 46 also removes first top side panel 170 from container 12. Similarly, second removable sidewall portion 342 extends from first edge 55 to second edge 56 and is connected to second top side panel 176 such that removing second removable sidewall portion 342 from second sidewall 48 also removes second top side panel 176 from container 12.

In addition, each end wall 36 includes an end wall perforation 346 that extends from leading edge 52 to trailing edge 53. End wall perforation 346 is oriented to enable a customer to remove top end panels 186 and 190 that are connected to respective end walls 36. By providing removable portions of sidewalls and top panels container assembly may be used to ship products to a store location and to display the products to a customer in the store.

In the exemplary embodiment, blank 328 includes at least one side panel perforation line 348 extending through each side panel 152 and 160 to define a removable side panel portion 350 of side panels 152 and 160, respectively. In one embodiment, side panel perforation line 348 is oriented with respect to each side panel 152 and 160 such that removable side panel portion 350 is connected to top side panels 170 and 176, respectively to enable top side panels 170 and 176 to be removed with removable side panel portions 350. In the exemplary embodiment, each end wall panel 156 and 164 also includes an end panel perforation 352 that extends between each end wall panel 156 and 164 and top panels 186 and 190, respectively, to enable top panels 186 and 190 to be removed from respective end wall panels 156 and 164.

Figure 20:
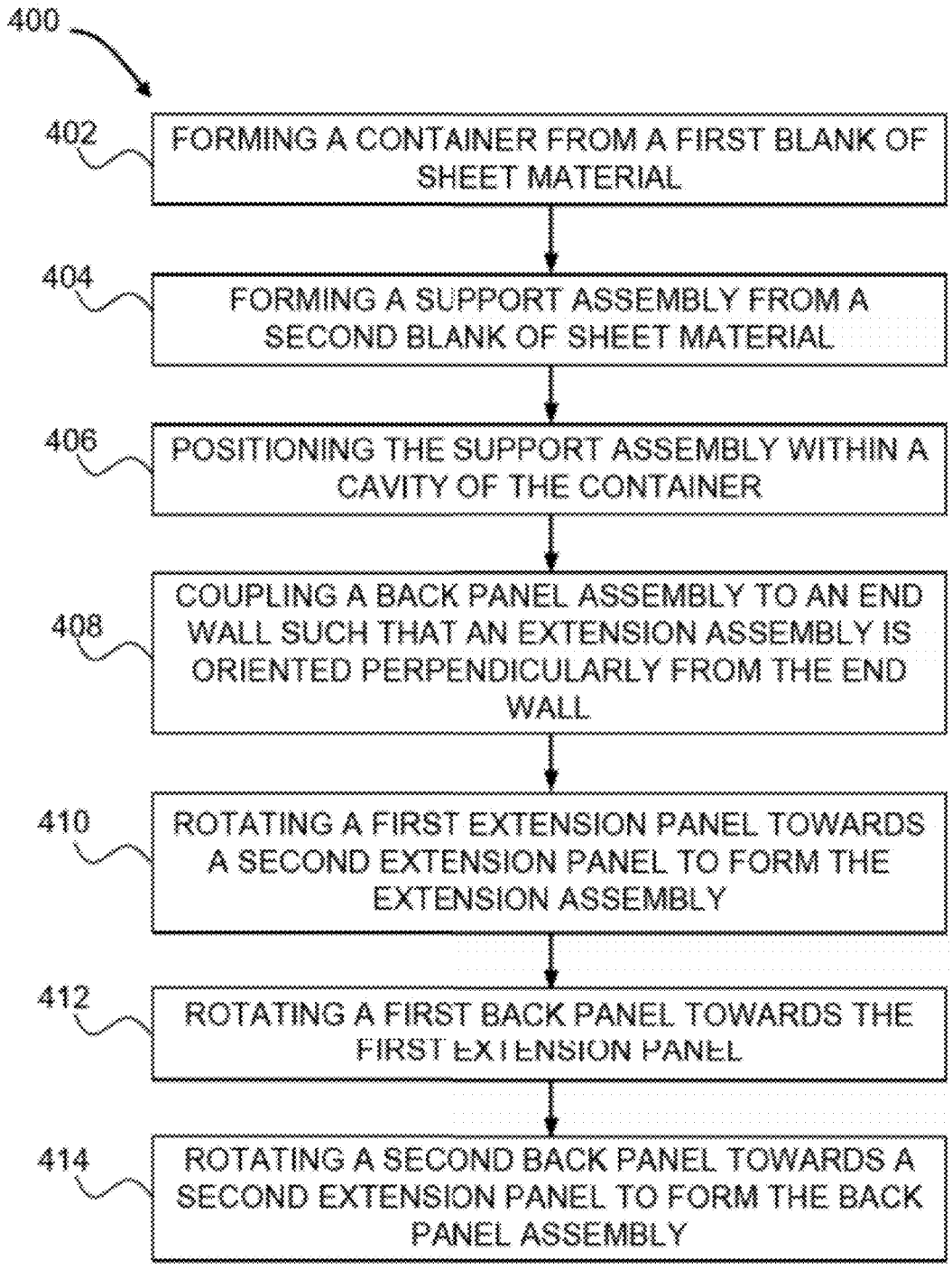
FIG. 20 is a flowchart illustrating an exemplary method for assembling the container assembly shown in FIG. 1.

FIG. 20 is a flowchart illustrating an exemplary method 400 for assembling container assembly 10. In the exemplary embodiment, method 400 includes forming 402 container 12 from a first blank 114, and forming 404 support assembly 14 from a second blank 206. Support assembly 14 is positioned 406 within container cavity 20. Back panel assembly 68 is coupled 408 to end wall 42 such that extension assembly 70 is oriented substantially perpendicularly from end wall 42 and extends into cavity 20.

Method 400 also includes rotating 410 first extension panel 238 towards second extension panel 240, such that first extension panel 238 is in a face-to-face relationship with second extension panel 240 to form extension assembly 70. First back panel 236 is rotated 412 towards first extension panel 238 such that first back panel 236 is oriented substantially perpendicularly to first extension panel 238. Second back panel 242 is rotated 414 towards second extension panel 240 such that second back panel 242 is oriented substantially perpendicularly to second extension panel 240, and such that first and second back panels 236 and 242 each extend outwardly from extension assembly 70 in opposite directions to form back panel assembly 68.

In one embodiment, method 400 includes rotating first corner panel 272 towards first back panel 236 and first extension panel 238 such that first corner panel 272 is oriented obliquely with respect to first back panel 236. Second corner panel 274 is rotated towards second back panel 242 and second extension panel 240 such that second corner panel 274 is oriented obliquely with respect to second back panel 242.

In another embodiment, method 400 includes rotating first sidewall panel 296 towards first back panel 236 such that first sidewall panel 296 is oriented substantially perpendicularly to first back panel 236. Second sidewall panel 298 is rotated towards second back panel 242 such that second sidewall panel 298 is oriented substantially perpendicularly to second back panel 242.

In the exemplary embodiment, method 400 also includes rotating side panels 152 and 160 toward end wall panels 156 and 164 to form a pair of opposing sidewalls 40 and a pair of opposing end walls 36. First corner panel, or leading corner panel 150 is rotated towards fourth corner panel, or trailing corner panel 162, such that leading corner panel 150 overlaps at least a portion of trailing corner panel 162 to form fourth corner wall 66 of container 12. Leading corner panel 150 is coupled to trailing corner panel 162 to form a manufacture's joint such that container has 8-sides. Bottom wall panels 172, 174, 188, and 190 are rotated toward side panels 152 and 160 to form bottom wall 16, and to form container 12 having cavity 20 defined therein.

The size and shape of support assembly 14 is selected to increase the stacking strength and rigidity of container 12 to facilitate container 12 being formed using less blank material. Moreover, size and shape of extension assembly 70 are selected to only extend partially across the volume of container 12 such that container assembly 10 may be converted to a display assembly and extension assemblies 70 do not block a customer's view of the products stored proximate the rear of container assembly 70. By providing a container assembly that includes a support assembly positioned within a container, the container may be formed using less material than known containers with the stacking strength and rigidity of the container increased. Thus, the cost of fabricating the container assembly is reduced over known containers.

The above-described methods and systems overcome at least some disadvantages of known containers by providing a container assembly that includes a container and a support assembly positioned within the container. Moreover, the support assembly includes a back panel assembly that is coupled to an inner surface of the container to increase the stacking strength and structural rigidity of the container. In addition, the support assembly includes an extension assembly that extends only partially into the container cavity to reduce the movement of goods stored within the container during transportation, and to enable the container assembly to be converted to a display assembly without blocking a customer's view of the products stored proximate the rear of the container. As such, the container assembly described herein may be formed with increased stacking strength and structural rigidity and with less material over known containers, thus reducing the cost of fabricating the container assembly.

Exemplary embodiments of a reinforcing support assembly for a container and method for making the reinforcing support assembly are described above in detail. The systems and methods are not limited to the specific embodiments described herein, but rather, components of the systems and/or steps of the methods may be utilized independently and separately from other components and/or steps described herein. For example, the methods may also be used in combination with other container assemblies, and are not limited to practice with only the container assembly described herein. Rather, the exemplary embodiment can be implemented and utilized in connection with many other container assembly applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container assembly comprising:

a container formed from a first blank of sheet material, said container comprising a bottom wall and at least eight sides extending upwardly from said bottom wall for defining a cavity therein, wherein each side comprises an inner surface that defines a substantially continuous, rectangular shape extending between a bottom edge positioned adjacent said bottom wall and a top edge, each said inner surface extends to a first height measured between said top edge and said bottom edge; and at least one support assembly formed from a second blank of sheet material and positioned within said cavity, said support assembly comprising a back panel assembly coupled to said inner surface of one of the plurality of sides and an extension assembly extending outwardly from said back panel assembly, said extension assembly extends only partially across said cavity, said back panel assembly including a height measured between a lower edge positioned adjacent said bottom wall and an opposite upper edge, wherein said back panel assembly height is approximately equal to said inner surface first height.

2. A container assembly in accordance with claim 1, wherein said extension assembly is oriented substantially perpendicular to said back panel assembly.

3. A container assembly in accordance with claim 1, wherein said extension assembly includes a first extension panel and a second extension panel, said second extension panel is oriented substantially parallel to said first extension panel, each of said first and second extension panels oriented substantially perpendicularly to said back panel assembly.

4. A container assembly in accordance with claim 1, wherein said back panel assembly comprises a first back panel and a second back panel, said first and second back panels extending outwardly from said extension assembly in opposite directions.

5. A container assembly in accordance with claim 1, wherein said container comprises a first end wall, a second opposite end wall, a first sidewall, and a second opposite sidewall, said first and second sidewalls extend substantially perpendicularly between said first and second end walls such that said cavity is defined between said first and second end walls and said first and second sidewalls, wherein said back panel assembly is coupled to said first end wall such that said extension assembly extends outwardly from said back panel assembly towards said second end wall.

6. A container assembly in accordance with claim 5, wherein said container further comprises a plurality of corner walls extending between each of said first and second end walls and said first and second sidewalls, said corner walls oriented obliquely with respect to said end walls and said sidewalls.

7. A container assembly in accordance with claim 6, further comprising a first support assembly coupled to said first end wall, and a second opposite support assembly coupled to said second end wall.

8. A container assembly in accordance with claim 6, wherein said first and second end walls each include a leading edge, a trailing edge, and a length measured between said leading edge and said trailing edge, said back panel assembly comprising a first side edge, a second opposite side edge, and a length measured between said first side edge and said second side edge, wherein said back panel assembly length is approximately equal to said end panel length.

9. A container assembly in accordance with claim 6, wherein said back panel assembly comprises a first back panel extending outwardly from said extension assembly, a second back panel extending outwardly from said extension assembly in a direction opposite to said first back panel, a first corner panel extending outwardly from said first back panel, and a second corner panel extending outwardly from said second back panel, wherein said first and second corner panels of said back panel assembly extend across at least a portion of a corresponding corner wall of said container.

10. A container assembly in accordance with claim 9, wherein said back panel assembly further comprises a first sidewall panel extending outwardly from said first corner panel and a second sidewall panel extending outwardly from said second corner panel, wherein each of said first and second sidewall panels extend across at least a portion of a corresponding container sidewall.

11. A container assembly formed from a plurality of blanks of sheet material comprising:

a container formed from a first blank of sheet material, said container comprising a bottom wall, a pair of end walls, a pair of sidewalls extending between said pair of end walls, and a plurality of corner walls extending between each of said end walls and each of said sidewalls such that a cavity is defined between said bottom wall, said end walls, said sidewalls, and said corner walls, wherein each of said end walls, said sidewalls, and said corner walls comprises an inner surface that defines a substantially continuous, rectangular shape extending between a bottom edge positioned adjacent said bottom wall and a top edge, each said inner surface extends to a first height measured between said top edge and said bottom edge; and at least one support assembly formed from a second blank of sheet material and positioned within said cavity, said support assembly comprising a pair of back panels and a pair of extension panels, said pair of back panels coupled to a first end wall of said pair of end walls in a face-to-face relationship, wherein said pair of extension panels extend outwardly from said pair of back panels only partially across said cavity towards a second end wall, each back panel of said pair of back panels extends outwardly from said pair of extension panels in an opposite direction.

12. A container assembly in accordance with claim 11, wherein said support assembly includes a height that is approximately equal to the first height.

13. A container assembly in accordance with claim 11, wherein each end wall includes a length measured between a leading edge and a trailing edge, said pair of back panels includes a length that is approximately equal to the length of each end wall.

14. A container assembly in accordance with claim 11, wherein said support assembly further comprises a pair of corner panels coupled to corresponding corner walls of said container, wherein a first corner panel extends outwardly from a first back panel and a second corner panel extends outwardly from a second back panel.

15. A container assembly in accordance with claim 14, wherein said support assembly further comprises a pair of sidewall panels coupled to corresponding sidewalls of said container, wherein a first sidewall panel extends outwardly from said first corner panel and a second sidewall panel extends outwardly from said second corner panel.

16. A container assembly in accordance with claim 11, further comprising a first support assembly coupled to said first end wall of said container, and a second support assembly coupled to a second opposite end wall of said container.

17. A blank assembly for forming a container assembly including a container and a support assembly positioned within the container, said blank assembly comprising:

a first blank of sheet material for forming the support assembly, said first blank comprising a plurality of panels, wherein each panel is foldably adjoined to an adjacent panel, said plurality of panels comprising a first back panel, a first extension panel connected to said first back panel, a second extension panel connected to said first extension panel such that said first extension panel is between said second extension panel and said first back panel, said first extension panel and said second extension panel each have a width defined along a centerline axis of said first blank, and a second back panel connected to said second extension panel such that said second extension panel is between said second back panel and said first extension panel; and a second blank of sheet material for forming the container defining a cavity sized to receive the support assembly therein, said second blank comprising a pair of end panels, a pair of side panels, and a plurality of corner panels coupled in series by a plurality of parallel fold lines, wherein a first side panel is foldably adjoined to an adjacent first bottom wall panel, and wherein each of said end panels, said side panels, and said corner panels comprises an inner surface that defines a substantially continuous, rectangular shape extending between a bottom edge and a top edge, each said inner surface extends to a first height measured between said top edge and said bottom edge, said first bottom wall panel having a width defined along a central axis of said second blank that is greater than each of said first extension panel width and said second extension panel width.

18. A blank assembly in accordance with claim 17, wherein said first blank further comprises one or more openings extending between said first extension panel and said second extension panel, each said opening configured to facilitate folding said first extension panel towards said second extension panel along a fold line.

19. A blank assembly in accordance with claim 17, wherein said first blank further comprises a plurality of folding members extending between each panel of said plurality of panels, each said folding member is pivotably connected between adjacent panels to enable each panel to pivot with respect to an adjacent panel.

20. A blank assembly in accordance with claim 17, wherein said first blank further comprises a first corner panel and a second corner panel, said first corner panel connected to said first back panel such that said first back panel is between said first corner panel and said first extension panel, said second corner panel connected to said second back panel such that said second back panel is between said second corner panel and said second extension panel.

21. A blank assembly in accordance with claim 20, wherein said first blank further comprises a first sidewall panel and a second sidewall panel, said first sidewall panel connected to said first corner panel such that said first corner panel is between said first sidewall panel and said first back panel, said second sidewall panel is connected to said second corner panel such that said second corner panel is between said second sidewall panel and said second back panel.

22. A blank assembly in accordance with claim 17, wherein said first bottom wall panel is one of a plurality of bottom wall panels extending outwardly from said bottom edge of each of said end and side panels, and wherein said second blank further comprises a plurality of top wall panels extending outwardly from said top edge of each of said end and side panels.

23. A method of forming a container assembly from a blank assembly, said method comprising:

forming a container from a first blank of sheet material, the container including a bottom wall, a pair of end walls, a pair of sidewalls extending between the pair of end walls, and a plurality of corner walls, wherein at least one sidewall extends outwardly from the bottom wall such that a cavity is defined therein and wherein each of the end walls, the sidewalls, and the corner walls comprises an inner surface that defines a substantially continuous, rectangular shape extending between a bottom edge positioned adjacent said bottom wall and a top edge, each inner surface extends to a first height measured between the top edge and the bottom edge;

forming a support assembly from a second blank of sheet material, the support assembly including an extension assembly extending outwardly from a back panel assembly;

positioning the support assembly within the container cavity; and coupling the back panel assembly to an end wall of the container such that the extension assembly is oriented substantially perpendicularly from the end wall and extends only partially across the cavity.

24. A method in accordance with claim 23, wherein the second blank of sheet material includes a plurality of panels including a first back panel, a first extension panel connected to the first back panel, a second extension panel connected to the first extension panel such that the first extension panel is between the second extension panel and the first back panel, and a second back panel connected to the second extension panel such that the second extension panel is between the second back panel and the first extension panel, said method further comprises:

rotating the first extension panel towards the second extension panel, such the first extension panel is in a face-to-face relationship with the second extension panel to form the extension assembly of the support assembly;

rotating the first back panel towards the first extension panel such that the first back panel is oriented perpendicular to the first extension panel; and rotating the second back panel towards the second extension panel such that the second back panel is oriented perpendicular to the second extension panel, and such that the first and second back panels extend outwardly from the extension assembly in opposite directions to form the back panel assembly of the support assembly.

25. A method in accordance with claim 23, wherein the first blank includes a plurality of bottom wall panels extending outwardly from the bottom edge of each of the end and side panels, and a plurality of top wall panels extending outwardly from the top edge of each of the end and side panels, the first blank extending between a leading corner panel and a trailing corner panel, said method further comprising:

rotating the pair of side panels toward the pair of end panels to form the pair of opposing sidewalls and the pair of opposing end walls to form the container;

rotating the leading corner panel toward the trailing corner panel such that the leading corner panel overlaps at least a portion of the trailing corner panel;

coupling the leading corner panel to the trailing corner panel; and rotating the plurality of bottom wall panels toward the side panels to form the bottom wall of the container such that the cavity is defined therein.

* * * * *